US012630261B2

(12) United States Patent
Poe et al.

(10) Patent No.: US 12,630,261 B2
(45) **Date of Patent: *May 19, 2026**

(54) SYSTEM AND METHOD FOR ENHANCED MARINE VESSEL EFFICIENCY USING INTEGRATED HULL OPTIMIZATIONS

(71) Applicant: Shipglide, Inc., Fort Lauderdale, FL (US)

(72) Inventors: Richard Poe, Vail, CO (US); John Dixon, Fort Lauderdale, FL (US); David Bell, Naples, FL (US); Danilo Contreras, Davie, FL (US)

(73) Assignee: Airglide AI, Inc, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/948,969

(22) Filed: Nov. 15, 2024

(65) Prior Publication Data

US 2025/0074547 A1 Mar. 6, 2025

Related U.S. Application Data

(63) Continuation-in-part of application No. 18/219,375, filed on Jul. 7, 2023, now Pat. No. 12,263,914, which
(Continued)

(51) Int. Cl.
*B63B 1/38* (2006.01)
*B63B 19/00* (2006.01)
(Continued)

(52) U.S. Cl.
CPC ..... *B63B 1/38* (2013.01); *B63B 19/00* (2013.01); *B63B 49/00* (2013.01); *B63H 25/42* (2013.01);
(Continued)

(58) Field of Classification Search
CPC ..... B63B 1/38; B63B 2001/382; B63B 2001/385; B63B 2001/387; B63B 19/00; B63B 59/04; B63H 25/42; B63H 25/46
See application file for complete search history.

(56) References Cited

U.S. PATENT DOCUMENTS 280,913 A * 7/1883 Laval ..... B63B 1/38 114/67 R
661,303 A * 11/1900 Briggs ..... B63B 1/38 114/67 A
(Continued)

FOREIGN PATENT DOCUMENTS

JP 2010083412 A * 4/2010 ..... B63B 1/32
KR 20130000054 A * 1/2013

*Primary Examiner* — Ajay Vasudeva
(74) *Attorney, Agent, or Firm* — Origins Law, LLC; Nicholas Spatola

(57) ABSTRACT

A system and method for enhancing marine vessel efficiency through integrated hull optimizations is disclosed. The system includes automated bow thruster covers that reduce hull drag and condition water flow, coupled with strategically positioned air lubrication nozzles that create and maintain an air layer under the vessel. The bow thruster covers may be configured as circular doors or parallel panels, optionally incorporating air discharge ports or working in conjunction with dedicated air jets. An intelligent control system optimizes the integrated components using real-time sensor data and computational fluid dynamic analysis. The system modulates air distribution and cover positions based on sea conditions and vessel speed, maintaining optimal efficiency during operation. External surfaces may incorporate superaerophilic structures to enhance air retention and reduce drag. The comprehensive integration of these components provides improved hydrodynamic efficiency while maintaining full bow thruster functionality when required.

15 Claims, 22 Drawing Sheets

Related U.S. Application Data is a continuation-in-part of application No. 18/119,324, filed on Mar. 9, 2023, now Pat. No. 12,097,932.

(60) Provisional application No. 63/599,360, filed on Nov. 15, 2023, provisional application No. 63/454,549, filed on Mar. 24, 2023, provisional application No. 63/439,306, filed on Jan. 17, 2023, provisional application No. 63/427,144, filed on Nov. 22, 2022.

(51) Int. Cl.

| | |
|---|---|
| ***B63B 49/00*** | (2006.01) |
| ***B63B 59/04*** | (2006.01) |
| ***B63H 25/42*** | (2006.01) |
| ***B63H 25/46*** | (2006.01) |

(52) U.S. Cl.

CPC ..... *B63H 25/46* (2013.01); *B63B 2001/387* (2013.01); *B63B 59/04* (2013.01)

(56) References Cited

U.S. PATENT DOCUMENTS

| | | | | | |
|---|---|---|---|---|---|
| 1,408,178 | A * | 2/1922 | Downing | B63H 19/06 | 114/67 A |
| 2,378,822 | A * | 6/1945 | Barry | B63B 1/38 | 114/67 A |
| 2,754,791 | A * | 7/1956 | Nieding | B63B 1/38 | 114/67 A |
| 6,994,045 | B2 * | 2/2006 | Paszkowski | B63B 1/38 | 114/67 R |
| 12,097,932 | B2 * | 9/2024 | Dixon | B63B 59/04 | |
| 12,263,914 | B2 * | 4/2025 | Dixon | B63B 1/38 | |

* cited by examiner

SYSTEM AND METHOD FOR ENHANCED MARINE VESSEL EFFICIENCY USING INTEGRATED HULL OPTIMIZATIONS

CROSS-REFERENCE TO RELATED APPLICATIONS

This application is a continuation-in-part of co-pending U.S. patent application Ser. No. 18/219,375, entitled "A System And Method For Delivering Air To A Submerged Ship Surface", filed Jul. 7, 2023, and claims priority pursuant to 35 U.S.C. § 119 (e) to U.S. Provisional Application Ser. No. 63/599,360, entitled "A Drag-Reducing Bow Thruster Cover For Maritime Vessels", filed Nov. 15, 2023. U.S. patent application Ser. No. 18/219,375 is a continuation-in-part of U.S. patent application Ser. No. 18/119,324, entitled "A System and Method for Reducing Drag on Hulls of Marine Crafts Thereby Increasing Fluid Dynamic Efficiencies", filed Mar. 9, 2023, now U.S. Pat. No. 12,097,932, which claims the benefit of priority pursuant to 35 U.S.C. § 119 (e) to U.S. Provisional Patent Application Ser. No. 63/439,306, filed Jan. 17, 2023, and U.S. Provisional Patent Application Ser. No. 63/427,144, filed Nov. 22, 2022. U.S. patent application Ser. No. 18/219,375 also claims priority pursuant to 35 U.S.C. § 119 (e) to U.S. Provisional Application Ser. No. 63/454,549, entitled "A System and Method for Delivering Air to a Submerged Ship Surface", filed Mar. 24, 2023. All of which are hereby incorporated by reference in their entireties for all purposes.

FIELD OF THE INVENTION

The present invention relates to components used to reduce the drag on a hull of a marine craft, including air lubrication systems, bow thruster covers, and automated control systems.

BACKGROUND

As fuel costs fluctuate, the marine industry is beginning to adapt to more energy efficient practices. Current technology implemented to solve this problem includes advanced hull shapes and designs, antifouling paints, and enhanced efficiency mechanical components.

One practice that has resulted from this more energy efficient shift is the theory of using air under a marine craft to provide a low frictional surface that reduces drag on the hull of the marine craft, known as hull air lubrication systems. However, current methods simply flood the area with air bubbles, many of which are wasted because they are too far away from the hull of the surface, and thus, the energy savings are often completely offset by the energy required to run the system. This leads to ship engineers turning the systems off because the use of these systems leads to more maintenance required without an efficiency benefit.

To produce a viable air lubrication system, the system must be able to account for various sources of drag. U.S. patent application Ser. No. 18/119,324, entitled "A System and Method for Reducing Drag on Hulls of Marine Crafts Thereby Increasing Fluid Dynamic Efficiencies" focuses on a superaerophilic bottom hull surface to maintain an air plastron by encouraging air to adhere to the surface. That disclosure also introduces the air distribution system from compressors to the surface. U.S. patent application Ser. No. 18/219,375, entitled "A System and Method for Delivering Air to a Submerged Ship Surface" introduces a nozzle system to take air from the air distribution system and disburse it strategically below the hull of a ship, which is more readily deployable than having a porous layer as described in the previous application. However, the embodiments in these applications alone can be enhanced with further contemplation.

Bow thrusters are auxiliary propulsion devices installed in the bow of maritime vessels, enabling better maneuverability at low speeds or when docking. These devices are particularly crucial for large vessels, such as cargo ships and cruise liners, where precise control is essential during harbor operations. Bow thrusters function by allowing water to flow through a transverse tunnel at the bow, generating lateral thrust.

However, the presence of the bow thruster tunnel introduces significant issues—increased hydrodynamic drag and creation of turbulent water prior to reaching an air lubrication nozzle. The drag occurs due to the disruption in the smooth flow of water along the vessel's hull, caused by the open tunnel. The consequence of this drag is a decrease in the vessel's overall efficiency, leading to higher fuel consumption and, consequently, increased operational costs and environmental impact. However, this also creates an issue for air lubrication nozzles, as the water becomes turbulent, affecting the efficiency of the system and the creation of a thin layer of air.

The efficiency loss is particularly noticeable in long-distance voyages where vessels operate at higher speeds and for prolonged periods. At these speeds, even a small increase in drag can lead to substantial fuel wastage.

In light of this, there has been a growing need for a mechanism to mitigate the drag caused by bow thruster tunnels. The proposed solution is a closable bow thruster cover—a device designed to streamline the hull when the bow thruster is not in use. By covering the tunnel, the vessel's hydrodynamic profile is significantly improved, leading to reduced drag and more efficient fuel usage. The covers disclosed herein also reduce turbulence associated with transverse tunnels, thereby providing a stable flow of water, to the air lubrication system nozzles. The system disclosed herein also provides an additional solution of distributing air at the bow of a ship at the location of the pre-existing cavities for bow thruster covers, which in turn reduce drag at the furthest-most point of a ship.

Thus, a need exists in the market for a bow thruster cover, capable of maintaining a smooth and consistent hull surface is needed to reduce unnecessary drag and turbulence on the maritime vessel's hull.

Additionally, with the multiplicity of components of the system described herein, an additional component is increasingly necessary: an automated control system. While current air lubrication systems can be turned on and off by the user, it is not efficient in varying sea states where the hull is not perfectly flat. In such situations, air will dissipate towards the side it can rise fastest, leading to large swaths of areas of the ship hull which are then subjected to drag once again. In order for actual efficiency, an intelligent air lubrication system capable of monitoring sea states as a product of real-time feedback and adjusting the system based on the data is needed to optimize air outflow and flap/cover closure is imperative to continued savings in real-world conditions.

SUMMARY OF THE INVENTION

The invention disclosed herein provides a drag-reducing marine craft hatch. The drag-reducing marine craft hatch comprises a moveable transverse tunnel cover having an external submerged surface. The external submerged surface has a plurality of superaerophilic inducing microscopic and nanoscopic structures imprinted within the external submerged surface, forming a superaerophilic inducing surface. Each superaerophilic inducing microscopic structure defines a trench and a ridge geometry, wherein each ridge structure defines a protruding structure.

The invention disclosed herein further provides a hydrodynamically optimized submerged surface of a marine craft. The hydrodynamically optimized submerged surface of a marine craft includes at least one moveable transverse tunnel cover and an air lubrication nozzle assembly. These surfaces for a substantially flush closure when not in use to avoid hydrodynamic drag. The air lubrication nozzle assembly includes a main body having an open cavity therein, and a flow modulating nozzle flap coupled to at least one longitudinal engagement area. The air lubrication nozzle assembly is operable in a submerged environment. The main body of the air lubrication nozzle assembly includes a gas flow inlet, and an open lower boundary configured to receive a flow modulating nozzle flap. The flap of the air lubrication nozzle assembly is configured to modulate and balance a direction and flow rate of a gaseous flow. The embodiment also creates an engaged air layer created from an air supply of the gaseous.

The invention disclosed herein yet further provides a method for increasing efficiency of a watercraft by reducing drag. The method includes configuring portions of a ship's hull for air delivery to the ship hull's lower surface by providing at least one air delivery nozzle. Each of air delivery nozzle is an air lubrication nozzle assembly. The method includes providing the air lubrication nozzle assembly. The air lubrication nozzle assembly is capable of being immersed continuously in a liquid. The air lubrication nozzle assembly includes a main body having an open cavity therein, wherein the main body includes a gas flow inlet, and an open air-interface boundary is disposed at a lower horizontal plane of a submerged hull of a ship surrounding the air-interface boundary. The air lubrication nozzle assembly is operable in a submerged environment. The method further includes providing a stratified flow of water to the open interface boundary disposed at the lower horizontal plane by providing a pair of transverse tunnel covers at distal openings of a submerged transverse tunnel for each submerged transverse tunnel at a bow of the ship. the water flows over the exposed surface of each transverse tunnel cover, thereby reducing turbulence and hydrodynamic drag caused by non-hydrodynamically optimized surfaces. Each moveable transverse tunnel cover is disposed at a submerged substantially vertical plane.

The invention disclosed herein also provides an active system for reducing hydrodynamic drag on a hull of a marine craft, is disclosed. The system comprises an automated air distribution system. The automated air distribution system includes at least one compressor with a distributed automation-control module, at least one airflow modulation valves, and at least one air lubrication nozzle. The automated air distribution system couples one or more compressors to an automated valve with a plurality of air conduits. The automated air distribution system couples each automated valve to at least one air lubrication nozzles with at least one air conduit. Each automated valve includes a distributed automation-control module. The system also includes at least one moveable transverse tunnel cover with an external submerged surface. Each moveable transverse tunnel cover includes a controllable actuator, a user interface module, and a central automation-control module electronically coupled to at least each distributed automation-control module on each compressor, each distributed automation-control module at each automated valve, each controllable actuator, and coupled to the user interface module.

It is an object of the present invention to provide a system for reducing hydrodynamic drag on marine vessels through integrated hull optimizations including automated air lubrication control and dynamically adjustable hull features.

It is yet another object of the present invention is to provide a It is yet another object of the present invention to provide a bow thruster cover assembly that reduces turbulence and enables strategic air distribution at the forward sections of a marine vessel while maintaining operational functionality of the bow thruster.

It is a further object to provide a It is a further object to provide an intelligent control system that optimizes air distribution and hull feature positions based on real-time sea state conditions and computational fluid dynamic analysis to maintain maximum efficiency during vessel operation.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
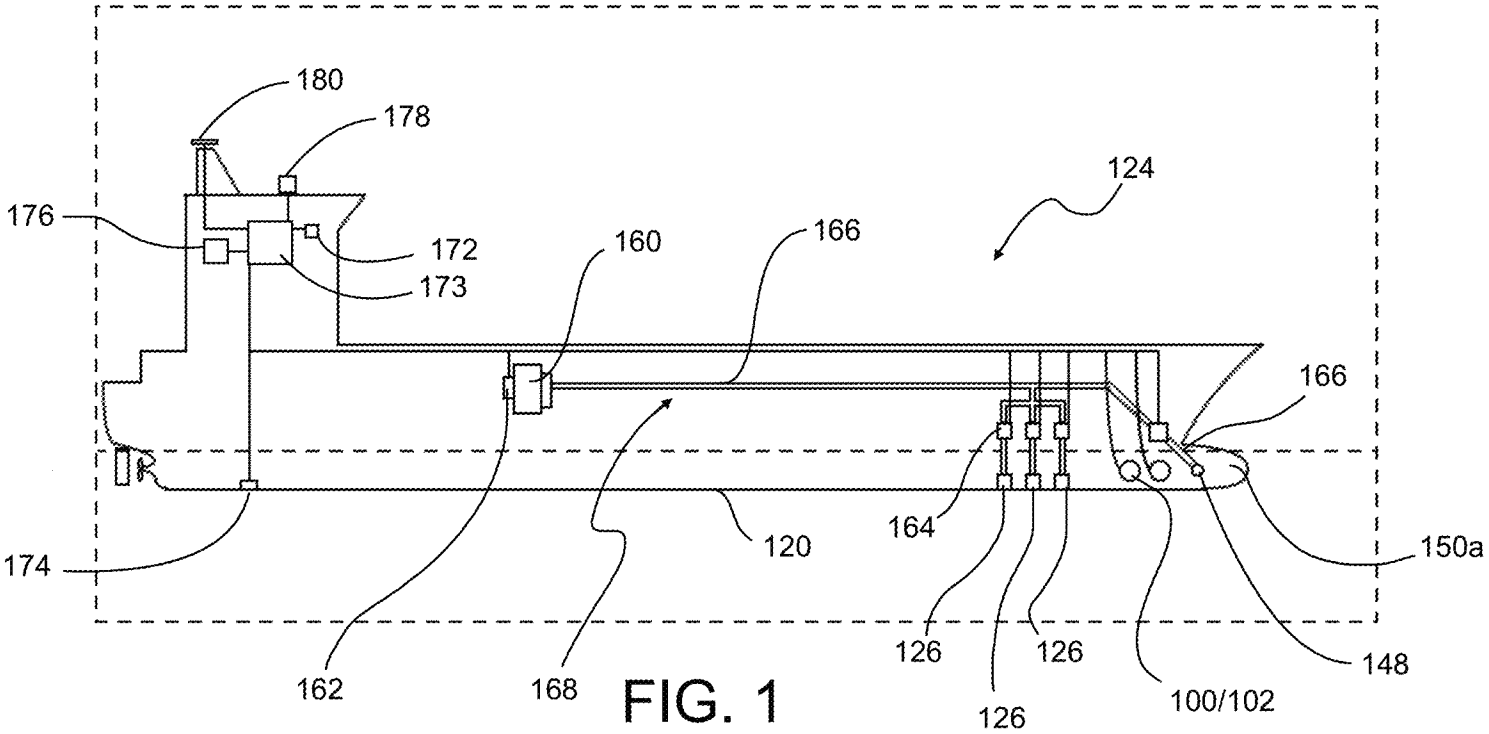
FIG. 1 illustrates a cross-sectional side view of the system shown in a marine vessel.

The invention herein provides a solution for reducing marine vessel energy inefficiencies caused by hull drag, turbulent water flow from bow thruster tunnels, and inconsistent air lubrication distribution in varying sea conditions. The invention includes a uniquely configured system of automated bow thruster covers integrated with an intelligent air lubrication system capable of solving the pre-stated issues.

Current marine vessel efficiency solutions rely on disconnected approaches, basic hull designs, and simple air bubble systems. These independent solutions operate in isolation, without considering their impact on each other or their combined effect on vessel performance. The result is sub-optimal efficiency gains that often fall short of theoretical expectations.

Furthermore, existing air lubrication systems waste energy by flooding areas with excess air bubbles, while unprotected bow thruster tunnels create persistent turbulence that disrupts smooth water flow. These issues are exacerbated by the lack of intelligent control systems, leading ship engineers to frequently disable efficiency systems due to their poor performance in real-world conditions and increased maintenance requirements.

The current invention solves these problems by introducing an integrated approach that combines adaptive bow thruster covers with strategic air distribution points and intelligent control systems. This solution creates a synergistic effect where the bow thruster covers not only reduce drag but also condition water flow to enhance air lubrication effectiveness, while real-time computational analysis continuously optimizes the entire system's performance based on actual operating conditions. The integration of these components, coupled with automated control and real-time adaptation, represents a significant advancement in marine vessel efficiency technology.

The invention herein provides a solution for several issues by incorporating a unique air distribution nozzle that minimizes water friction drag and controls the output of lubricating air based on the velocity of a ship with the invention installed. Distributing air to a hull surface immersed continually in a liquid is achieved by introducing an array of nozzles throughout a ship hull bottom surface. The nozzles have the ability to close automatically when airflow is cut to the nozzle by utilizing the hydrodynamic forces of the water which the ship is traversing to push the nozzle flap close. The nozzle also opens when supplied with pressurized air. An air distribution system without a means to close the air distribution nozzle/port will create undue drag when a ship is underway, when not releasing the friction reducing air bubbles.

The nozzle system includes a nozzle assembly with a main body having a cavity for receiving an air supply from a feed pipe, whereby the air supply is diffused in the cavity uniformly, whereby the air supply flow approaches a closeable lower opening. A flap at the closeable lower opening modulates the flow of air out of the nozzle. Thus, the invention includes a configured recessed sea chest forming the nozzle assembly along with a substantially flush-fitting flap.

Another major issue that plagues current nozzle designs in the industry is the creation of oscillations during air delivery that mimic wave patterns. The Kelvin-Helmholtz instability properties, or the instability that can occur at the interface between two fluid layers of different densities and velocities when there is a velocity shear between them, can be a major problem for watercraft implementing air nozzles. This oscillation defeats the intention of keeping the supplied air close to a ship hull for maximum efficiency. The design of the nozzle, disclosed herein, reduces oscillation of the released air onto the hull of a ship because of the narrow gap between the nozzle flap and the upper boundary, whereby the disbursed air forms a thin film which does not create turbulence.

To achieve nozzle activation, one or more air compressors within a ship will supply pressurized air to the nozzle. Pressure may be modulated at one or more valves upstream of the nozzle, to supply a variable supply of air, offering different flow rates at different nozzles to compensate for real-time sea conditions. The flow at each nozzle facilitates opening one or more flap mechanisms affixed onto the nozzle assembly main body. Once open, the nozzle assists in distributing the small air bubbles to the hull on the underside of a ship, creating what is known as an air plastron (the air between water and a ship hull surface). The nozzle also supports an engaged air layer under the hull once the air plastron is created, as long as the nozzle is pressurized.

Air distribution is monitored by air flow/pressure sensors just prior to the nozzles, which provides real-time feedback to a control module, which can then modulate one or more of the previously mentioned valves to deliver more air to nozzles with the most hydrodynamically efficient effect on the hull. The system also utilizes sensors to monitor sea state conditions of the vessel and predictive modeling to optimize where air is needed or will be needed. The system utilizes computational fluid dynamic (CFD) analysis in predictive modeling.

For a wetted surface to move more efficiently in water, this air plastron (an air layer) can be used. The efficiency of the air delivery system is dependent on minimizing the amount of excess air bubbles created. Over supply of air bubbles equates to overuse of energy to create those bubbles. The air plastron acts as a slippery layer thus reducing the solid-liquid interface of the hull surface. As the solid-liquid interface decreases, the frictional adhesion of water to the hull surface drops causing reduced water drag.

In an underwater environment, the air plastron experiences a gradual reduction of volume due to external hydrostatic pressure and a convection-diffusion mechanism. This invention actively replenishes the air plastron by pneumatically supplying air to a ship's hull bottom through unique nozzles in the bottom of the hull surface, thereby sustaining the air plastron immersed in water. Air used to replenish the air plastron may also be enriched with carbon molecules to accelerate and enhance the creation of drag reduction properties.

Related U.S. patent application Ser. No. 18/119,324, now U.S. Pat. No. 12,097,932, entitled "A System and Method for Reducing Drag on Hulls of Marine Crafts Thereby Increasing Fluid Dynamic Efficiencies", discloses creation of an air plastron using a constructed surface, which acts to attract air and repel water from the surface of the hull of a marine craft, all of which are incorporated in its entirety, herein.

For this implementation, one must appreciate the physics behind air plastron creation. Water is 50 times denser than air. Up to 90% of the drag on a ship comes from friction on the hull due to water density. A layer of air between a ship hull and the water a ship moves through can decrease that drag by up to 70%. The main elements opposing the movement of a ship through water are bow pressure, hull friction and the wake created as a ship moves through water.

This invention herein discloses a way to actively supply air to the plastron with the goal of reducing water friction using the structures and principles disclosed herein. Millimeter sized air bubbles shall be pneumatically delivered through one or more of these nozzles from a supply of compressed air within a ship. The pressure of compressed air shall be greater than that of the hydrostatic pressure of the water pushing up against the bottom of a ship equipped with said invention. The volume of supplied air will vary with the conditions of travel, including but not limited to sea state, speed through the water and water temperature.

With respect to the effects of delivering air to the nozzles, as more air is delivered to the nozzles the pressure in them will increase and the movable flap will open to accommodate the increased pressure. The closer that pressure is to the opposing hydrostatic pressure, the slower the diffusion of air from the cavities will be. If the rate at which the air is delivered is equal or greater than the rate of diffusion, the air plastron will remain stable and be sustained over time.

The nozzle design opens only when lubricating air is desired, and stays closed when not in use, automatically adapting to the needs of a ship. When not in use, the unique nozzle design is flush to a ship's hull and will not cause additional friction loss as with other nozzle designs. In use, the nozzle is designed to adjust itself to the conditions of ship speed and air released through the nozzle.

In some embodiments, a compressor puts out enough force to create a 3-psi difference between the combined hydrodynamic forces and the spring force of the self-closing means acting upon a lower surface of the flap, and the force of air coming through the feed pipe pushing against the upper surface of the flap, which will create a narrow longitudinal gap for an optimum gaseous flow to escape. This psi may be modified and independently configured for higher or lower psi to provide maximum efficiency for each application.

The nozzle includes a recessed portion, sometimes referred to as a sea chest or weldment. While sea chests are typically associated with receiving material, such as water with a seawater cooling circuit, the current sea chest defines a constructed cavern, or cavity, for diffusion of air or other gaseous output. This operation is more similar to what is commonly referred to as an air dispenser. However, the gaseous output in this application is forced through a linear nozzle opening. In some embodiments, the nozzle will be attached to an air accumulation tank to provide equal air delivery pressure across the width of the nozzle. An advantage of the use of a linear nozzle opening is the result in making the nozzle outlet aspect ratio wider than it is long, extending the distribution of bubbles along the axis of a ship. If an air accumulation tank is used, the air accumulation tank may incorporate internal air deflectors to distribute supplied air equally within the air accumulation tank. The overall body of the nozzle assembly provides for self-closing by leveraging the hydrodynamic force of the water the vessel is pressed against for constricting the output size of the nozzle or closing the nozzle altogether.

Related U.S. patent application Ser. No. 18/219,375, entitled "A System And Method For Delivering Air To A Submerged Ship Surface", discloses the above elements in further detail, all of which are incorporated in its entirety, herein.

The bow thruster cover assembly comprises a selectively actuatable barrier mechanism positioned at one or both apertures of a bow thruster tunnel that traverses the hull of a marine vessel. These covers can be implemented through various mechanical configurations, including but not limited to hinged doors, retractable panels, articulated louvers, or sliding mechanisms, all designed to modulate the hydrodynamic properties of the bow thruster tunnel during vessel operation.

When deployed in their closed position, the bow thruster covers substantially reduce parasitic drag that typically occurs within an open thruster tunnel. This drag reduction is achieved by preventing water ingress and subsequent turbulent flow through the tunnel when the thruster is not in active operation. The covers can be engineered with varying degrees of closure, from complete sealing to partial obstruction, depending on the specific operational requirements of the vessel and its air lubrication system.

The integration of bow thruster covers within an automated air lubrication system represents a sophisticated approach to drag reduction. The covers operate in concert with the air lubrication system through an intelligent control interface that monitors multiple parameters including vessel speed, trim angle, draft, and local water conditions. This integration allows for dynamic optimization of both systems to maximize overall drag reduction and energy efficiency.

The control system employs sensors to monitor the pressure differential across the bow thruster tunnel, water flow characteristics, and air injection patterns. This data is processed in real-time to determine optimal cover positions that complement the air lubrication system's operation. The control algorithm can adjust cover positions incrementally, allowing for fine-tuned optimization of water flow patterns around the air injection nozzles.

Careful design of the cover geometry can promote stratification of water flow in the vicinity of air lubrication nozzles. This stratification is crucial for maintaining laminar flow characteristics in the boundary layer where air injection occurs. The covers can be engineered with flow-conditioning features such as vortex generators or flow straighteners that help organize the water flow patterns before they interact with the injected air bubbles.

The bow thruster covers can be designed with variable positioning capabilities that allow them to create optimal flow conditions for different vessel operating states. For instance, at higher speeds, the covers might maintain a slightly open position that helps guide water flow in a manner that enhances the effectiveness of the air lubrication system. This controlled flow can help maintain the desired bubble size distribution and coverage area along the hull. When in an open state, an integrated airflow feed nozzle can expel gas from the aft side of the bow thruster cover, allowing air to be delivered at even the most forward portions of the bow, where pounding from the waves is most disruptive to the hydrodynamic efficiency of the hull. In these implementations, some covers may include a hollow portion to help facilitate the flow of air.

In some other similar implementations, the bow thruster covers are not hollow, but instead, air is delivered just forward of the bow thruster cover doors by an air jet installed forward of the bow thruster cover door to deliver a precisely controlled air supply to interact with the bow thruster cover, and any superaerophilic coating which may be applied to the bow thruster cover door.

Implementation of the covers can include pressure-relief mechanisms that automatically modulate their position in response to varying hydrodynamic conditions. These mechanisms ensure that the covers maintain optimal flow characteristics while preventing excessive strain on the actuation system. The pressure-relief feature also serves as a safety mechanism, preventing structural damage in extreme conditions.

The cover system can incorporate feedback mechanisms that continuously monitor the effectiveness of air bubble distribution and adjust accordingly. Sensors placed downstream of the air injection nozzles can measure bubble size, distribution, and persistence, allowing the control system to optimize cover positions for maximum air lubrication efficiency. This adaptive control ensures that the system maintains optimal performance across varying operational conditions.

Material selection for the covers plays a crucial role in their performance and longevity. The covers can be constructed from corrosion-resistant materials that maintain their hydrodynamic properties over extended periods. Surface treatments or coatings can be applied to the covers to further reduce friction and prevent marine growth, as discussed above, ensuring consistent performance of both the covers and the air lubrication system.

Advanced manufacturing techniques can be employed to create cover surfaces with microscale features that enhance their interaction with the water flow. These features might include riblets, dimples, or other surface modifications that help maintain laminar flow and reduce drag. The specific geometry of these features can be optimized for different vessel types and operating conditions.

The bow thruster covers can be designed with redundant actuation systems to ensure reliable operation in all conditions. These might include primary hydraulic or electric actuators with mechanical backup systems. The control system monitors actuator health and can switch between systems as needed to maintain optimal cover positioning and operation of the air lubrication system.

Feedback of the cover system may be provided to the vessel's broader operating systems allows for predictive maintenance and performance optimization. The control system can track cover operation over time, identifying patterns that might indicate maintenance requirements or opportunities for efficiency improvements. This data can also be used to refine control algorithms and improve overall system performance. However, in an ideal implementation, the system controlling the bow thruster covers will be federated to the intelligent air lubrication system, iALS, so that the system is independent of ship operations, whereby the system may receive one-way communication to remain independent of ship system malfunctions.

The importance of bow thruster covers in managing water flow turbulence cannot be overstated, particularly in the context of air lubrication systems. In an uncovered bow thruster tunnel, water entering the tunnel undergoes significant turbulence due to the sudden change in flow geometry and the presence of the thruster mechanism. This turbulence is characterized by chaotic fluctuations in fluid velocity and pressure, resulting in the formation of eddies and vortices within the tunnel.

As the vessel moves through the water, this turbulent flow exits the tunnel and interacts with the surrounding water along the hull. The region where this turbulent outflow meets the air lubrication system's nozzles is particularly critical. The nozzles, typically designed to operate in relatively smooth, laminar flow conditions, are tasked with introducing a layer of air bubbles at the boundary layer between the hull and the water. This air layer, when properly maintained, acts to reduce skin friction drag along the hull.

However, when turbulent water from an uncovered bow thruster tunnel reaches these nozzles, it disrupts the carefully calibrated air injection process. The chaotic motion of the turbulent water can cause irregular air bubble formation, leading to inconsistent bubble sizes and distribution patterns. Large eddies can momentarily increase local pressure at the nozzle outlets, potentially blocking air flow or causing erratic bubble release. Smaller scale turbulence can cause premature bubble breakup, reducing the effectiveness of the air layer.

Furthermore, the turbulent water flow can interfere with the adherence of the air bubbles to the hull surface. In optimal conditions, the air bubbles form a relatively stable layer that moves along the hull, continuously replenished by the nozzles. Turbulent flow can strip these bubbles away from the hull surface prematurely, preventing the formation of a consistent air layer. This results in patchy coverage, with some areas of the hull benefiting from air lubrication while others remain fully exposed to water friction.

The disruption caused by turbulent flow from an uncovered bow thruster tunnel can extend well beyond the immediate vicinity of the tunnel exit. The turbulence can propagate downstream along the hull, affecting air lubrication effectiveness over a significant portion of the vessel's length. This extended impact zone further emphasizes the importance of managing flow characteristics at the bow thruster tunnel.

By implementing a well-designed bow thruster cover system, these turbulence-related issues can be substantially mitigated. The covers, when closed, prevent water flow ingress into the tunnel, eliminating it as a source of turbulence. When partially open or equipped with flow-conditioning features, the covers can help manage and smooth the water flow around the tunnel area, providing a more favorable environment for the operation of the air lubrication nozzles.

The synergy between the bow thruster cover system and the air lubrication system extends beyond mere turbulence reduction. An intelligently controlled cover system can actively contribute to optimizing the performance of the air lubrication system. By modulating the cover position, the control system can fine-tune local water flow characteristics to enhance bubble formation, adherence, and distribution. This level of control allows for adaptation to varying vessel speeds, loads, and water conditions, ensuring consistent air lubrication performance across a wide range of operational scenarios.

The intersection of all of these systems play a role in providing a system and method for enhanced marine vessel efficiency using integrated hull optimizations. The system and method for enhanced marine vessel efficiency using integrated hull optimizations of the present invention may be used to provide a system for reducing hydrodynamic drag on marine vessels through integrated hull optimizations including automated air lubrication control and dynamically adjustable hull features, to provide a bow thruster cover assembly that reduces turbulence and enables strategic air distribution at the forward sections of a marine vessel while maintaining operational functionality of the bow thruster, and to provide an intelligent control system that optimizes air distribution and hull feature positions based on real-time sea state conditions and computational fluid dynamic analysis to maintain maximum efficiency during vessel operation. This apparatus and system are particularly shown in FIGS. 1-21.

FIG. 1 illustrates a cross-sectional side view of the active system 200 as implemented in a marine vessel 124. The system includes an automated air distribution system 168 comprising compressors 160 with distributed automation-control modules 162 connected via air conduits 166 to air lubrication nozzles 126 and bow thruster covers 100/102. The vessel may include a hull 120 with a bulbous bow 150*a* and strategically positioned air jets 148. The control architecture includes sea state sensors such as Doppler 174, gyro 176, radar 180, and GPS units 178, all connected to a central user interface 172 and control module 173.

Figure 2:
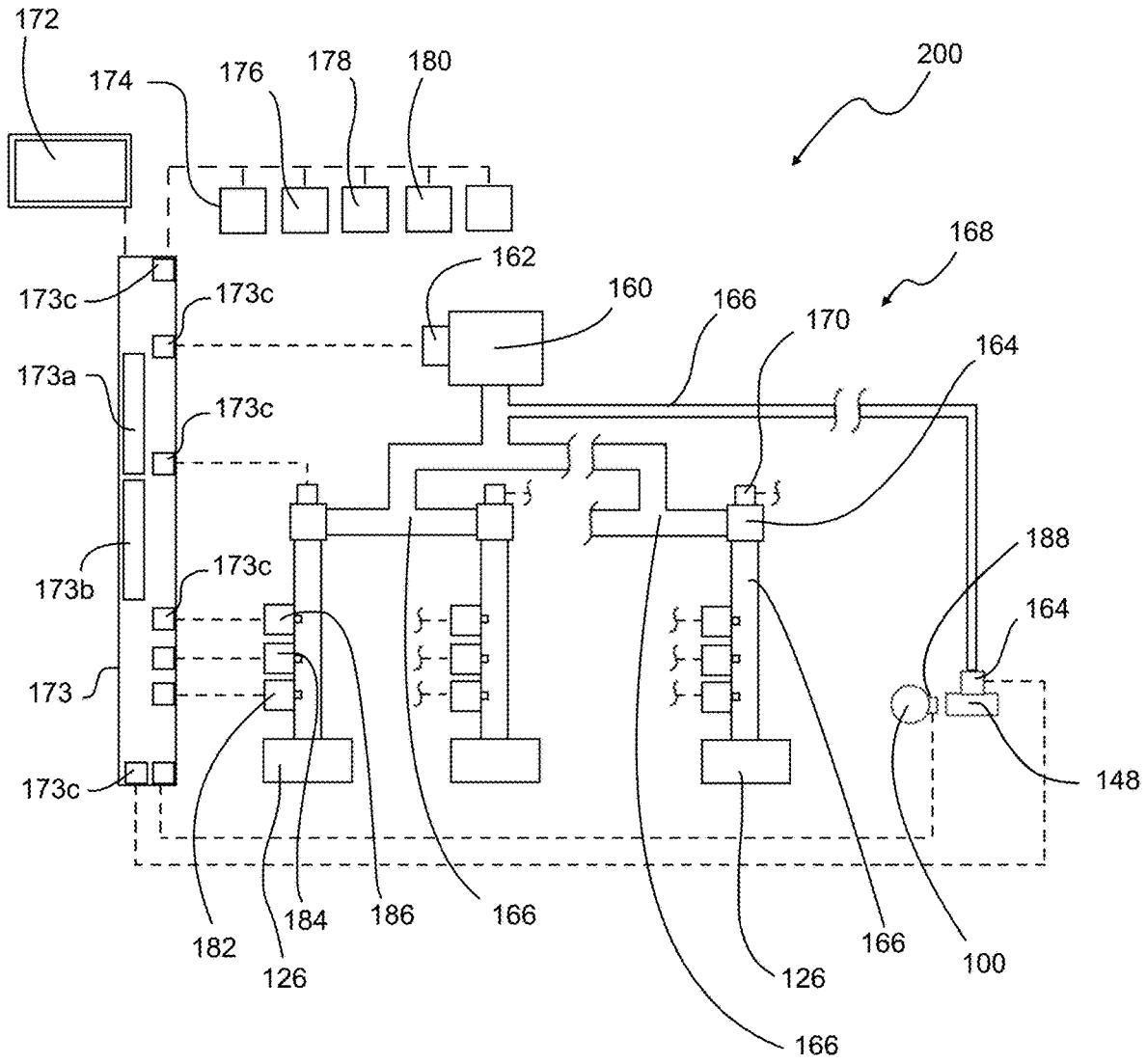
FIG. 2 illustrates a diagram view of the system.

FIG. 2 illustrates a diagram view of the control system architecture 200. The central automation-control module 173 includes a processor 173*a*, memory 173*b*, and input/output connections 173*c* interfacing with multiple system components. These components include sea state sensors (Doppler 174, gyro 176, GPS 178, radar 180), air monitoring sensors (temperature 182, speed 184, pressure 186), compressor control modules 162, valve control modules 170, actuator control modules 188, and the user interface module 172. The automated air distribution system 168 coordinates air flow through compressors 160, valves 164, and conduits 166 to nozzles 126 and bow thruster covers 100.

Figure 3:
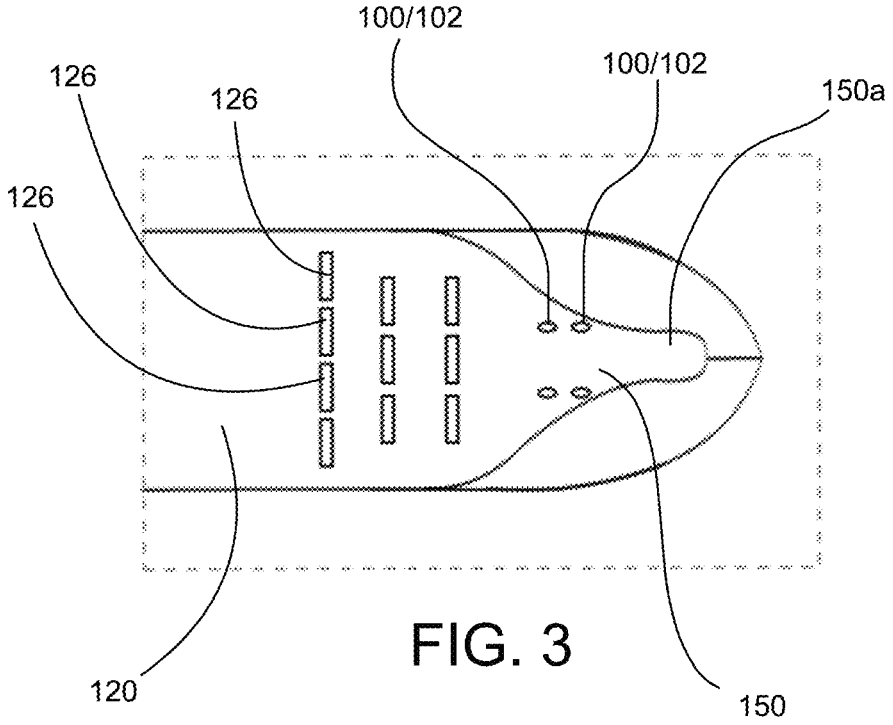
FIG. 3 illustrates a partial bottom view of the bow of a hull of the marine vessel showing a nozzle layout and bow thruster covers.

FIG. 3 illustrates a partial bottom view of the bow 150 and bulbous bow 150*a* section of the marine vessel hull 120, showing the strategic layout of air lubrication nozzles 126 and bow thruster covers 100/102 to optimize hydrodynamic efficiency.

Figure 4A:
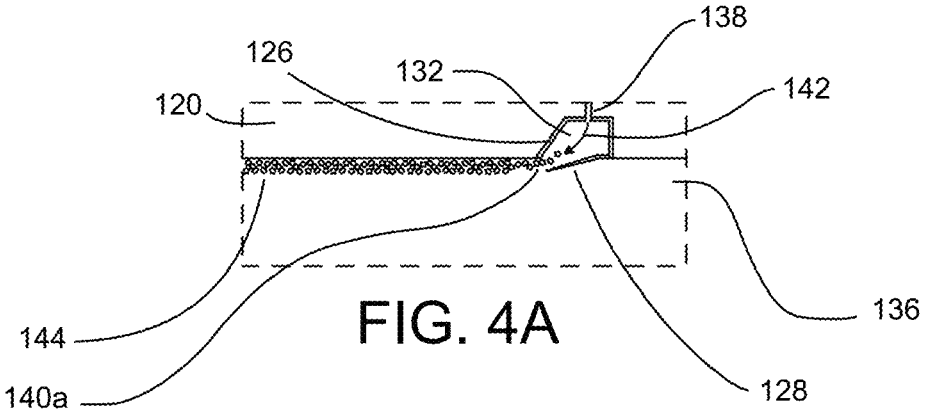
FIG. 4A illustrates a side view of a nozzle of the system disbursing air under the hull of the ship.

FIG. 4A illustrates a side view of an air lubrication nozzle 126 disbursing air under the hull 120 of the ship in a submerged environment 136. The nozzle assembly includes an open cavity 132, gas flow inlet 138, and a flow modulating nozzle flap 128. The gaseous flow 142 creates an air-interface boundary 140*a*, establishing an engaged air layer 144 along the hull surface.

Figure 4B:
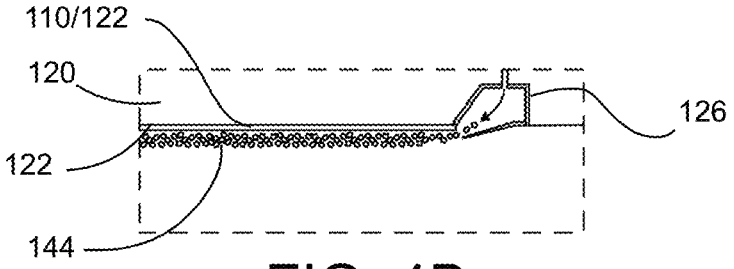
FIG. 4B illustrates a side view of a nozzle of the system disbursing air under the hull of the ship having a superaerophilic coating.

FIG. 4B illustrates a side view of an air lubrication nozzle 126 disbursing air under the hull 120 with a superaerophilic inducing surface 110/122. The hydrodynamically optimized surface 122 maintains an engaged air layer 144 more effectively than standard hull surfaces.

Figure 5:
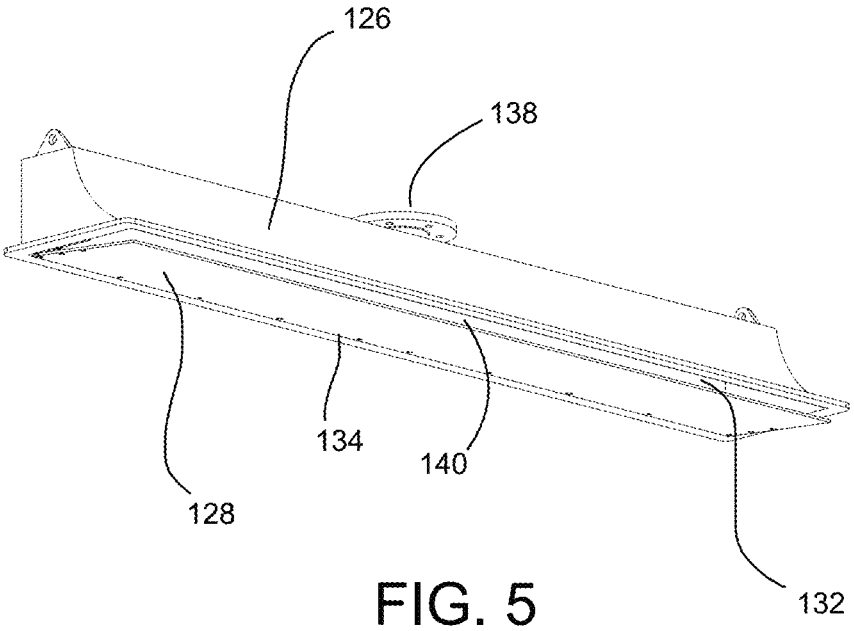
FIG. 5 illustrates an isometric bottom view of a nozzle of the air lubrication system in an opened position.

FIG. 5 illustrates an isometric bottom view of an air lubrication nozzle 126 in an opened position. The assembly includes a gas flow inlet 138, flow modulating nozzle flap 128, longitudinal engagement area 134, open cavity 132, and open lower boundary 140.

Figure 6:
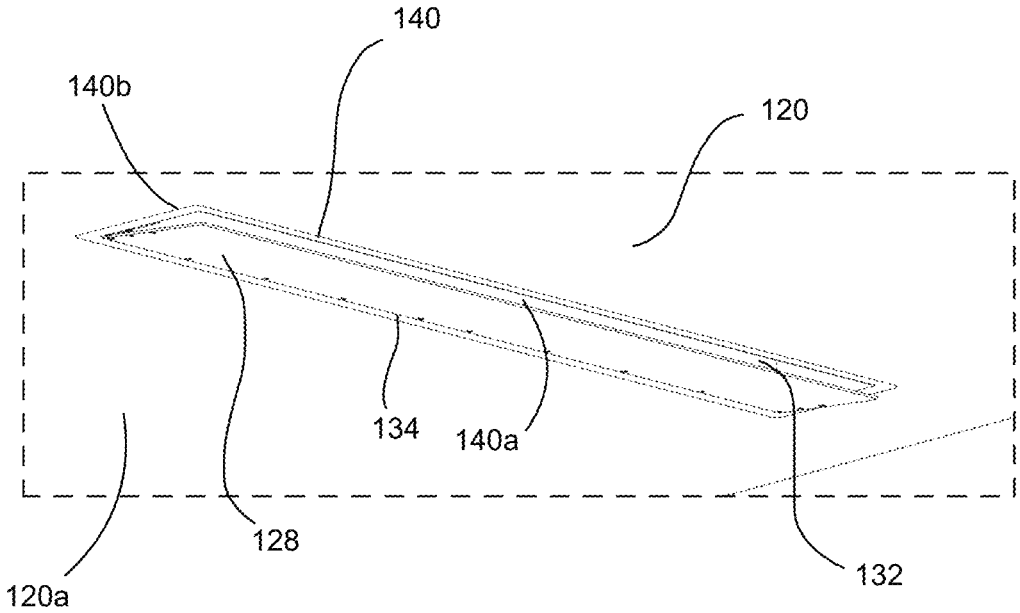
FIG. 6 illustrates an isometric bottom view of a marine vessel hull with a recessed nozzle of the air lubrication system in an opened position.

FIG. 6 illustrates an isometric bottom view of a marine vessel hull 120 with a recessed nozzle assembly 126. The configuration shows the relationship between the hull surface 120*a*, open cavity 132, air-interface boundary 140*a*, flow modulating flap 128, and lower horizontal plane 140*b* of the submerged hull.

Figure 7:
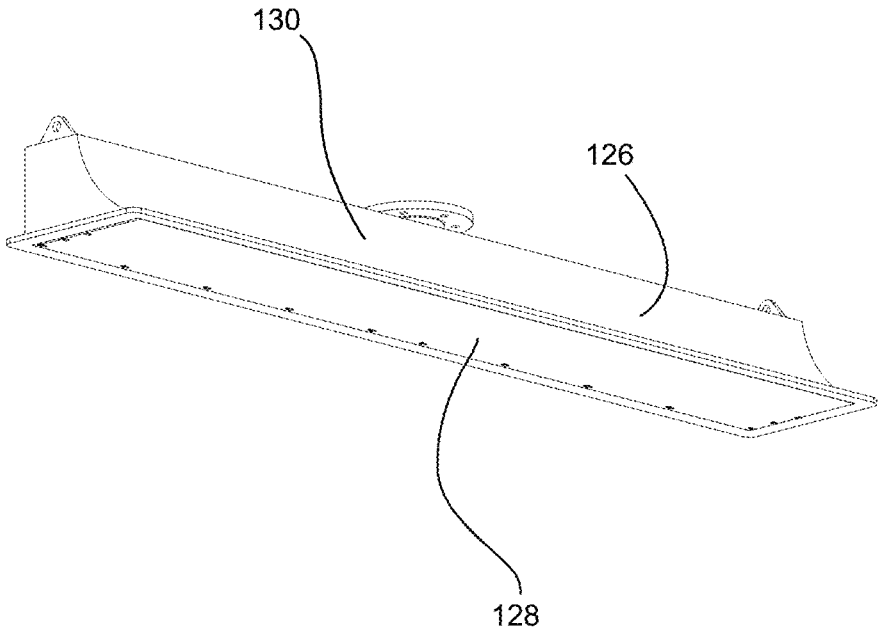
FIG. 7 illustrates an isometric bottom view of a nozzle of the air lubrication system in a closed position.

FIG. 7 illustrates an isometric bottom view of an air lubrication nozzle 126 in a closed position, showing the main body 130 and flow modulating nozzle flap 128 in its closed configuration.

Figure 8:
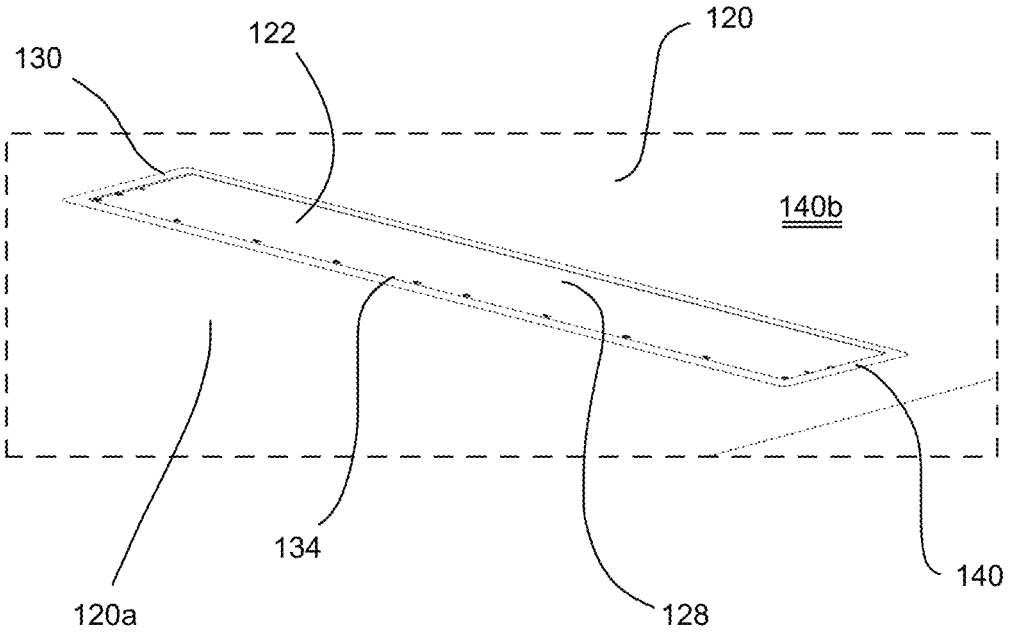
FIG. 8 illustrates an isometric bottom view of a marine vessel hull with a recessed nozzle of the air lubrication system in a closed position.

FIG. 8 illustrates an isometric bottom view of a marine vessel hull 120 with a recessed nozzle 126 in a closed position. The hydrodynamically optimized surface 122 shows the integration of the main body 130, hull surface 120*a*, longitudinal engagement area 134, flow modulating flap 128, and lower horizontal plane 140*b*.

Figure 9:
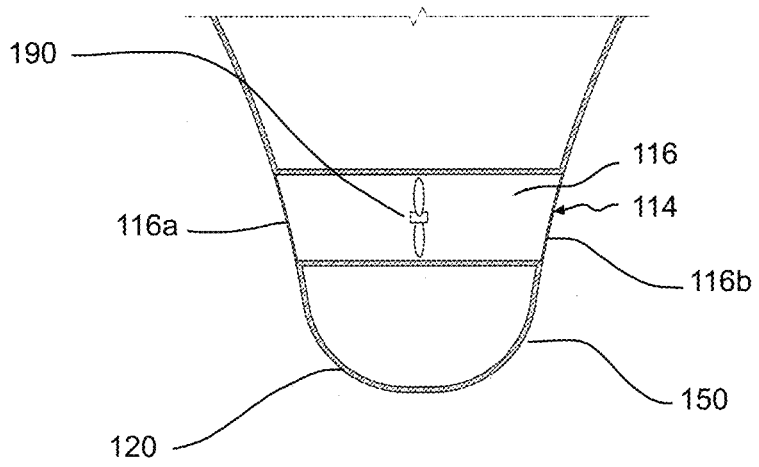
FIG. 9 illustrates a front cross-sectional view of a transverse tunnel and a bow thruster.

FIG. 9 illustrates a front cross-sectional view of a transverse tunnel 116 and bow thruster assembly 190. The configuration shows the hull 120, bow section 150, and tunnel openings 116*a*/116*b* with their respective apertures 114.

Figure 10:
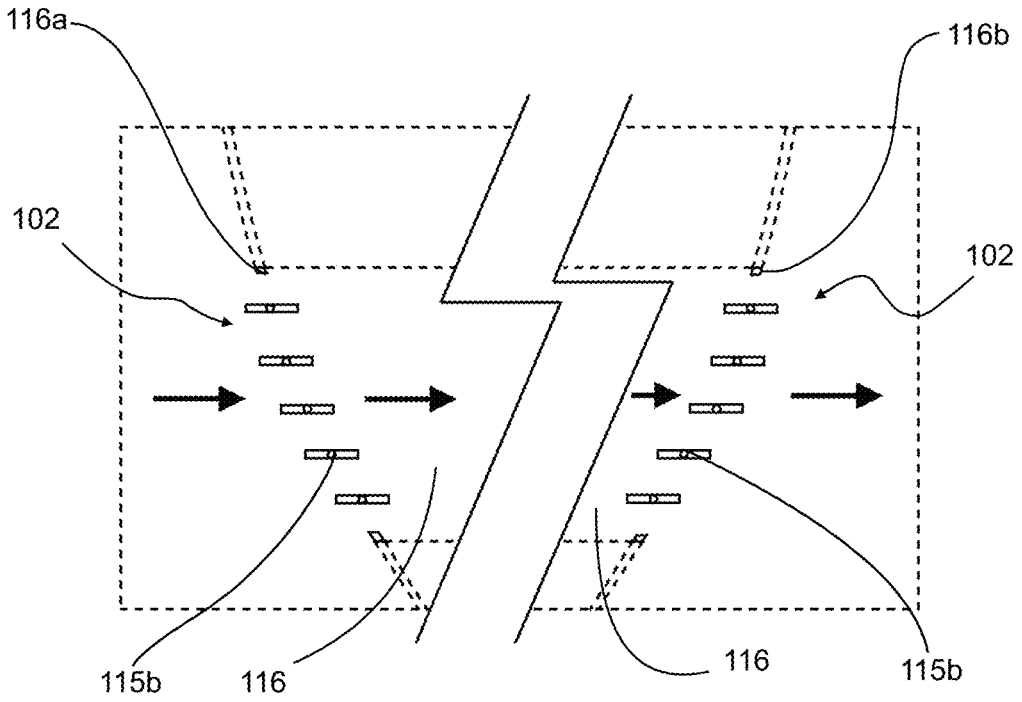
FIG. 10 illustrates a front cross-sectional view of end sections of the transverse tunnel with distal bow thruster covers.

FIG. 10 illustrates a front cross-sectional view of the transverse tunnel 116 end sections, showing distal bow thruster covers 102 with their rotational axes 115*b* at distal openings 116*a*/116*b*.

Figure 11B:
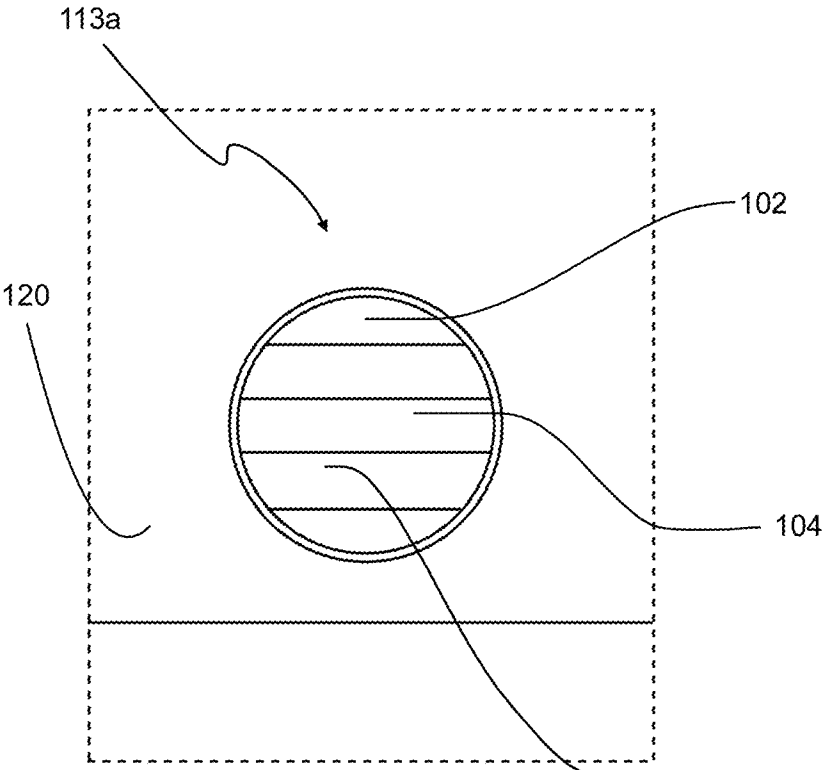
FIG. 11B illustrates a side view of a louvred-style transverse tunnel cover in a closed state.
Figure 11A:
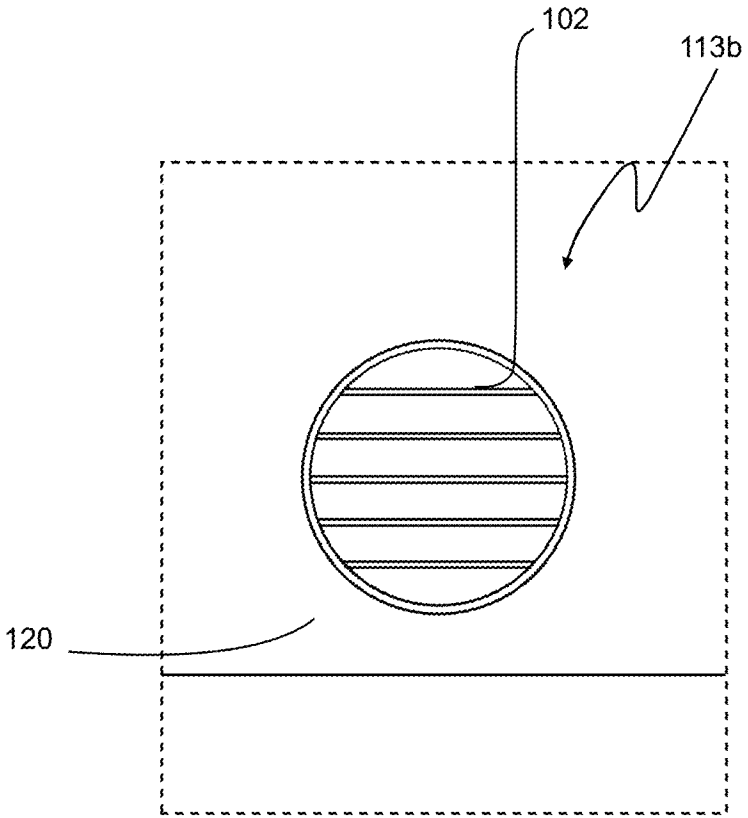
FIG. 11A illustrates a side view of a louvred-style transverse tunnel cover in an open state.

FIG. 11A illustrates a side view of a louvred-style transverse tunnel cover 102 mounted to the hull 120 in an open state 113*b*, allowing fluid flow through the tunnel 116.

FIG. 11B illustrates a side view of a louvred-style transverse tunnel cover 102 in a closed state 113*a*, showing the moveable parallel panels 112/112*b* forming a continuous external surface 104 flush with the hull 120.

Figure 12A:
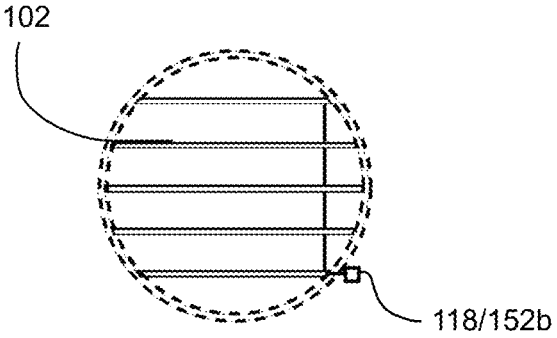
FIG. 12A illustrates a side view of the components of a louvred-style transverse tunnel cover in an open state.

FIG. 12A illustrates a side view of the components of a louvred-style transverse tunnel cover 102, showing the actuator/motor 118/152*b* configuration, with the cover 102 in an open state.

Figure 12B:
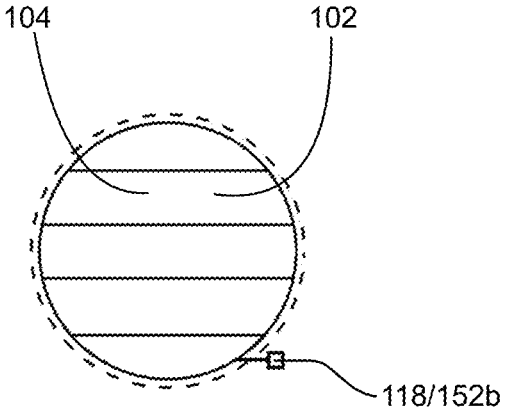
FIG. 12B illustrates a side view of the components of a louvred-style transverse tunnel cover in a closed state.

FIG. 12B illustrates a side view of the components of a louvred-style transverse tunnel cover 102, showing the external surface 104 and actuator/motor 118/152*b* configuration, with the cover 102 in a closed state.

Figure 13B:
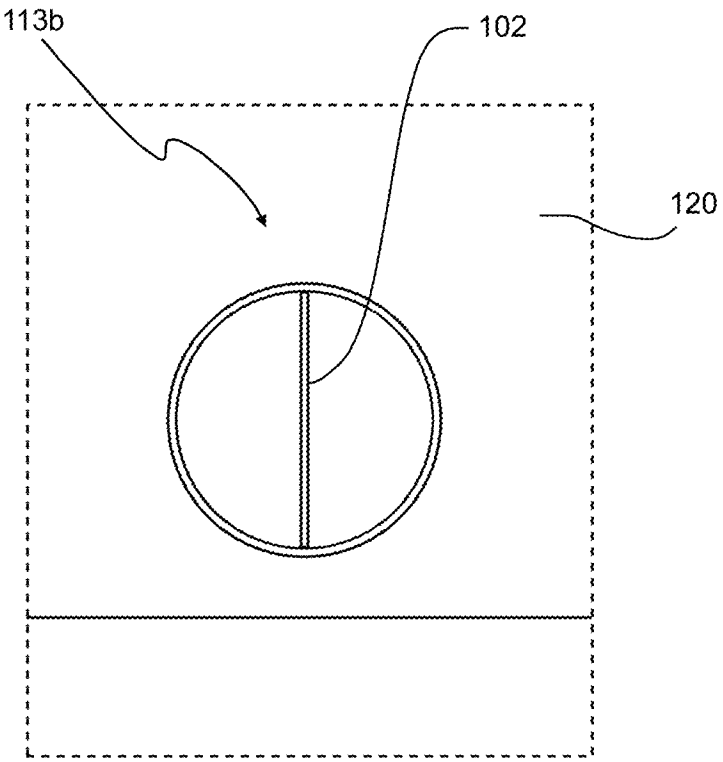
FIG. 13B illustrates a side view of a pivot-style transverse tunnel cover in an open state.
Figure 13A:
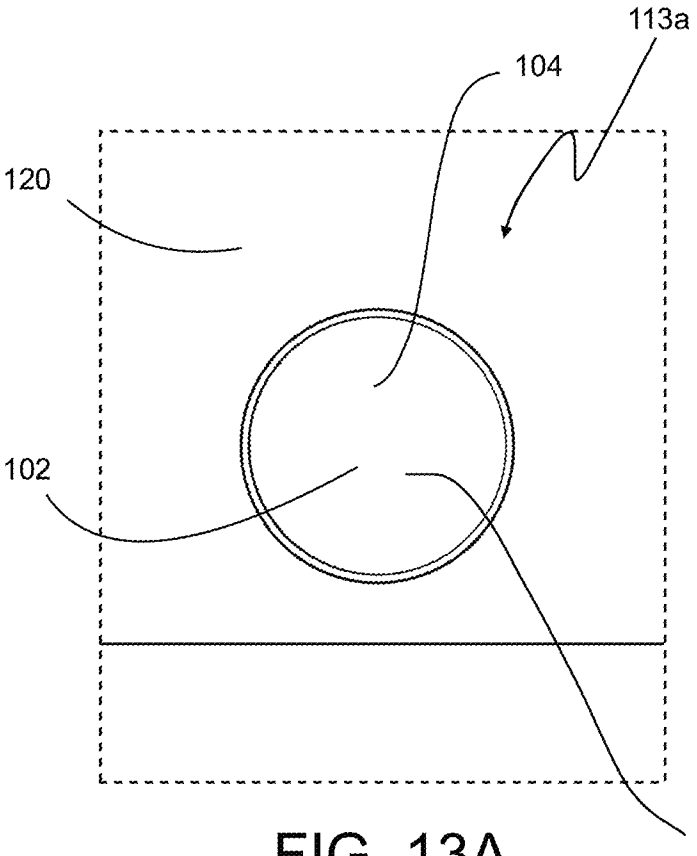
FIG. 13A illustrates a side view of a pivot-style transverse tunnel cover in a closed state.

FIG. 13A illustrates a side view of a pivot-style transverse tunnel cover 102 mounted to the hull 120 in a closed state 113*b*.

FIG. 13B illustrates a side view of a pivot-style transverse tunnel cover 102 in an open state 113*a*, showing the circular door 112/112*a*, external surface 104, and its relationship to the hull 120.

Figure 14A:
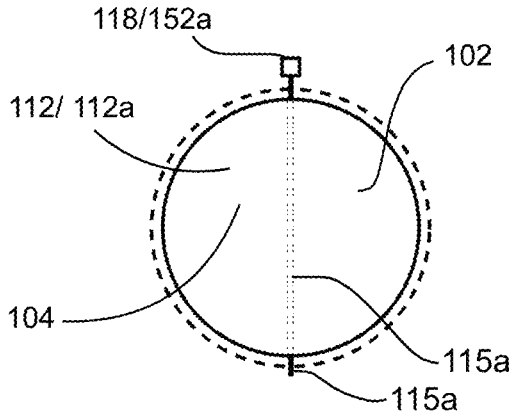
FIG. 14A illustrates a side view of the components of a pivot-style transverse tunnel cover in a closed state.

FIG. 14A illustrates a side view of the components of a pivot-style transverse tunnel cover 102, showing the circular door 112/112*a*, external surface 104, actuator/motor 118/152*a*, and integral shaft 115*a*, with the cover 102 shown in a closed state.

Figure 14B:
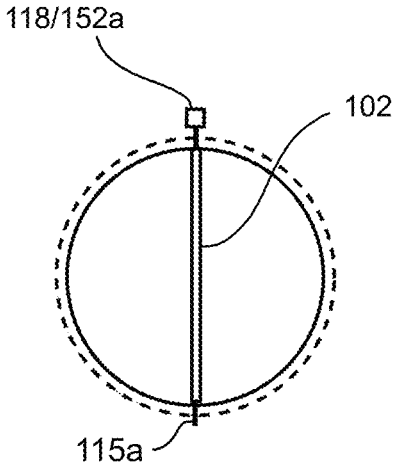
FIG. 14B illustrates a side view of the components of a pivot-style transverse tunnel cover in an open state.

FIG. 14B illustrates a side view of the components of a pivot-style transverse tunnel cover 102, showing the actuator/motor 118/152*a* and integral shaft 115*a* configuration, with the cover 102 shown in an open state.

Figure 15B:
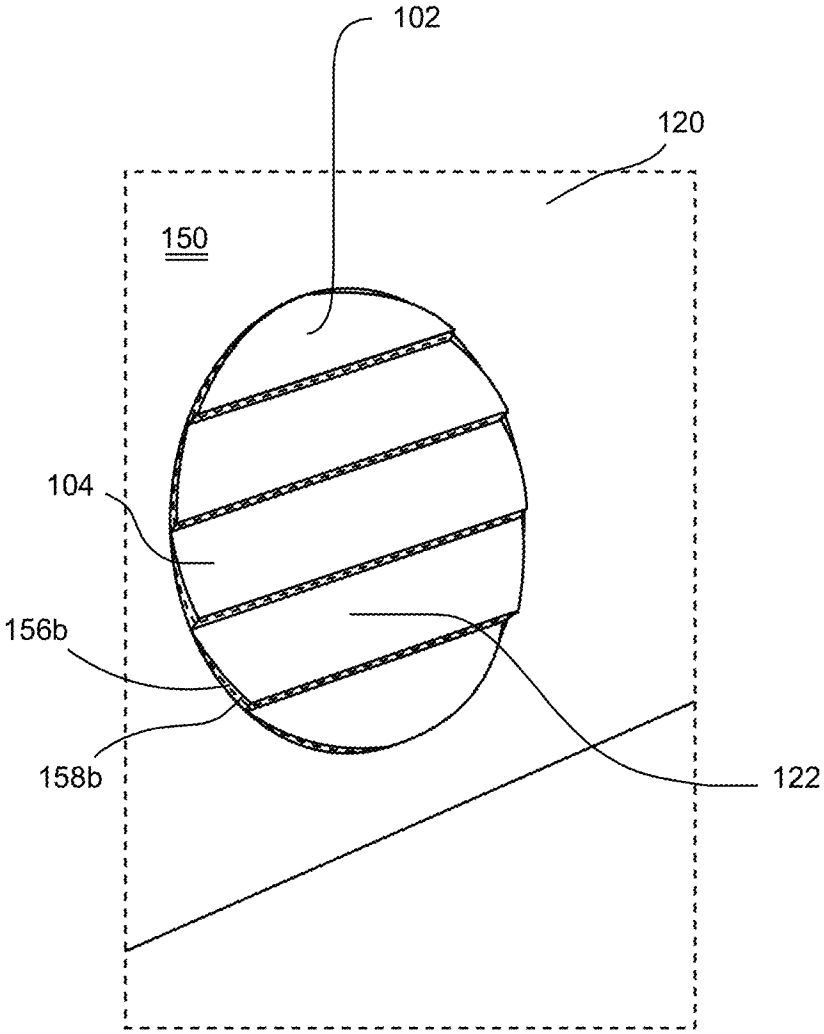
FIG. 15B illustrates an enlarged isometric view of a louvred-style transverse tunnel cover in a partially open state to expose air distribution channels.
Figure 15A:
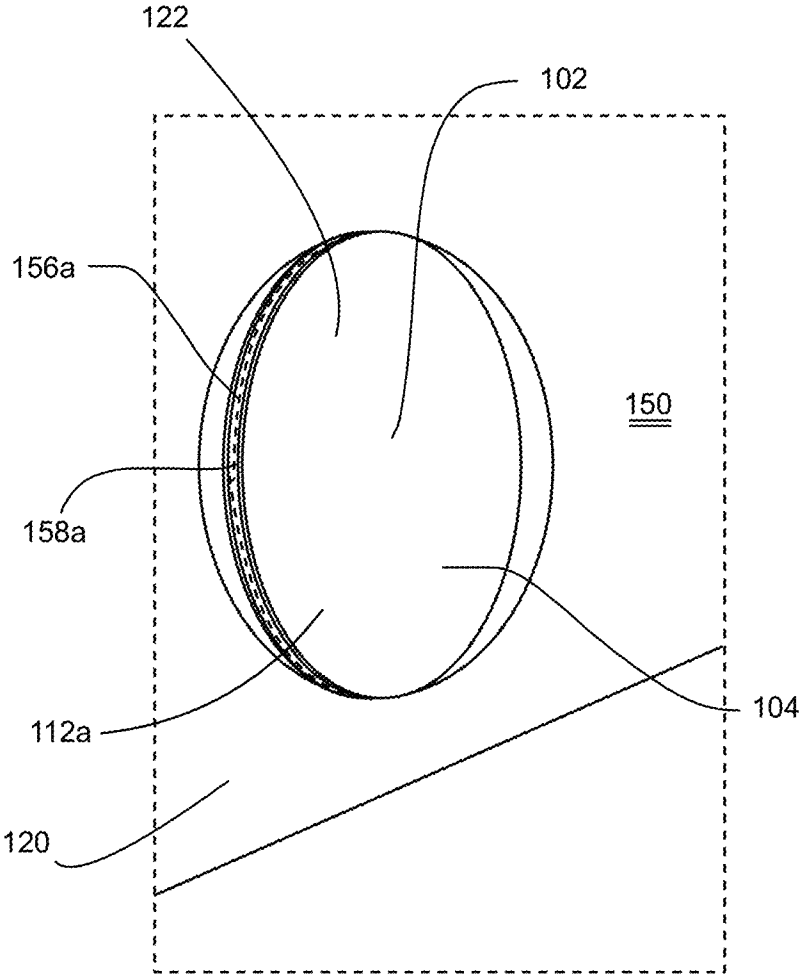
FIG. 15A illustrates an enlarged isometric view of a pivot-style transverse tunnel cover in a partially open state to expose air distribution channels.

FIG. 15A illustrates an enlarged isometric view of a pivot-style transverse tunnel cover 102 in a partially open state, showing the hull 120, bow section 150, hydrodynamically optimized surface 122, circular door 112*a*, external surface 104, and air discharge port 156*a* with its interior edge 158*a*.

FIG. 15B illustrates an enlarged isometric view of a louvred-style transverse tunnel cover 102 in a partially open state, showing the bow section 150, external surface 104, hull 120, hydrodynamically optimized surface 122, and air discharge ports 156*b* with their interior edges 158*b*.

Figure 16:
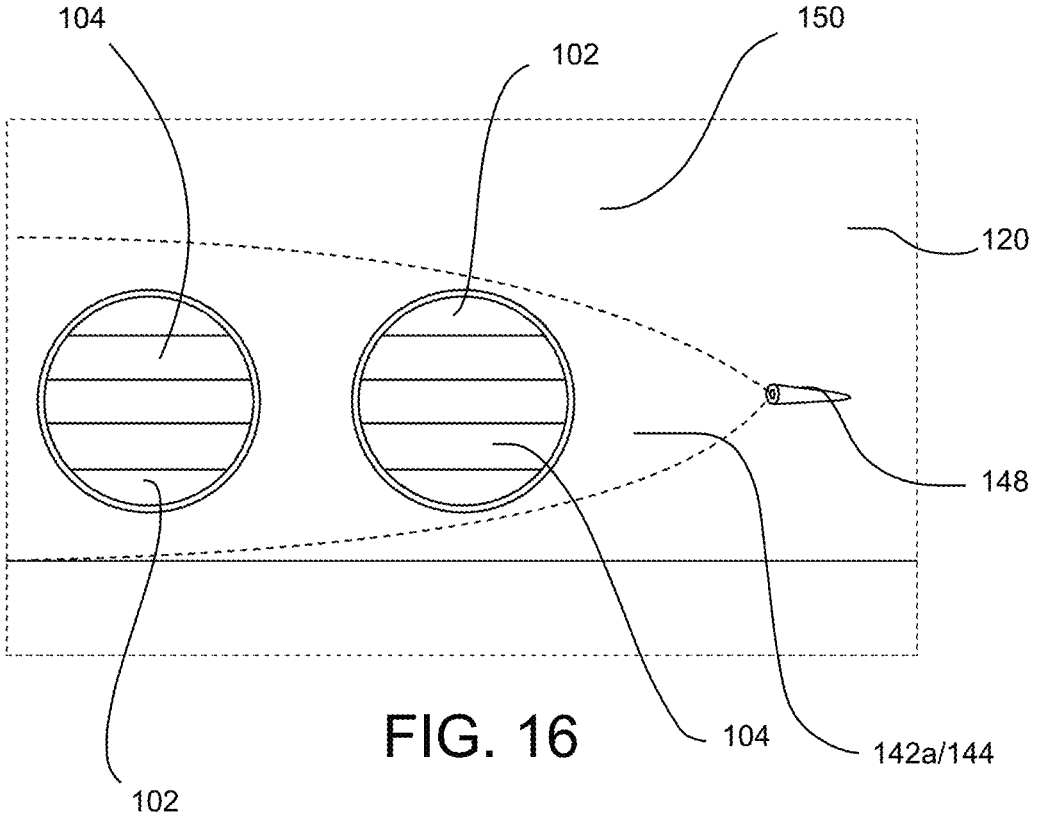
FIG. 16 illustrates a side view of multiple louvred-style transverse tunnel covers in a closed state with an air jet forward of the covers distributing air across the external surfaces.

FIG. 16 illustrates a side view of multiple louvred-style transverse tunnel covers 102 in a closed state, showing the external surfaces 104, bow section 150, hull 120, and an air jet 148 distributing an air flow 142*a*/144 across the external surfaces.

Figures 17A, 17B:
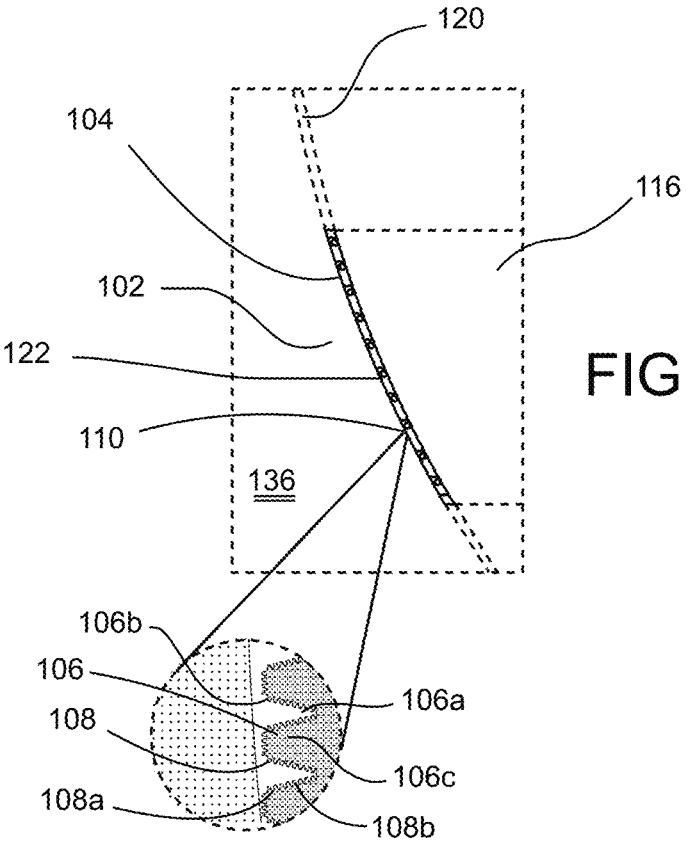
FIG. 17A illustrates a front cross-sectional view of a transverse tunnel cover in a closed state.
FIG. 17B illustrates an enlarged front cross-sectional view of a transverse tunnel cover in a closed state showing the external surface in a superaerophilic texture.

FIG. 17A illustrates a front cross-sectional view of a transverse tunnel cover 102 in a closed state, showing the transverse tunnel 116, hull 120, external surface 104, hydrodynamically optimized surface 122 with superaerophilic inducing surface 110 in the submerged environment 136.

FIG. 17B illustrates an enlarged front cross-sectional view of a transverse tunnel cover in a closed state, detailing the superaerophilic texture with microscopic structures 106 including ridges 106*b*, trenches 106*a*, and protruding structures 106*c*, as well as nanoscopic structures 108 with trenches 108*a* and ridges 108*b*.

Figure 18A:
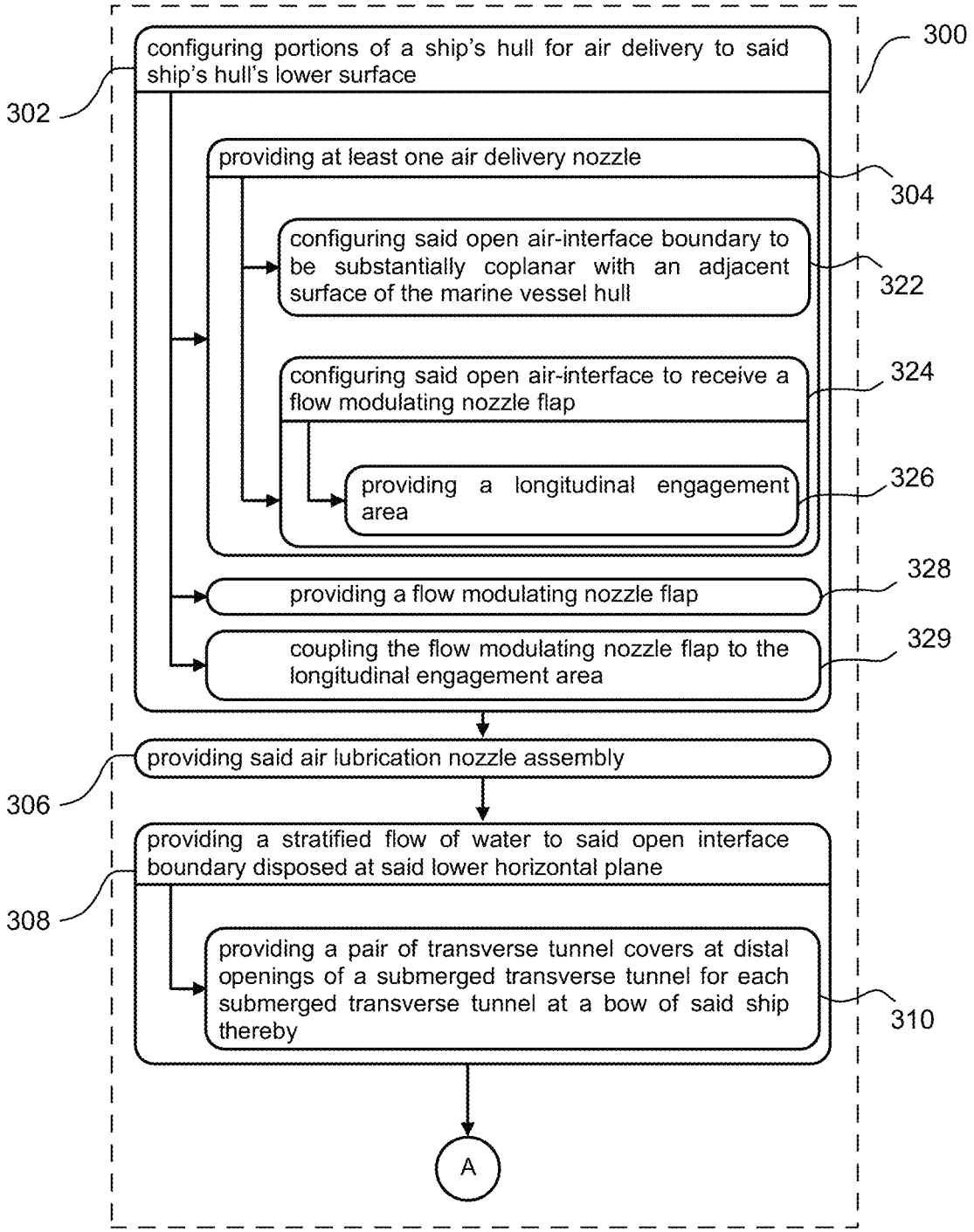
FIG. 18A illustrates a partial flow chart of a method for increasing efficiency of a watercraft by reducing drag.

FIG. 18A illustrates a partial flow chart of a method 300 for increasing efficiency of a watercraft by reducing drag, showing steps 302-329 including configuring 302, providing air delivery nozzles 304, providing nozzle assemblies 306, providing stratified flow 308, providing tunnel covers 310, configuring boundaries 322-324, providing engagement areas 326, providing flaps 328, and coupling components 329.

Figure 18B:
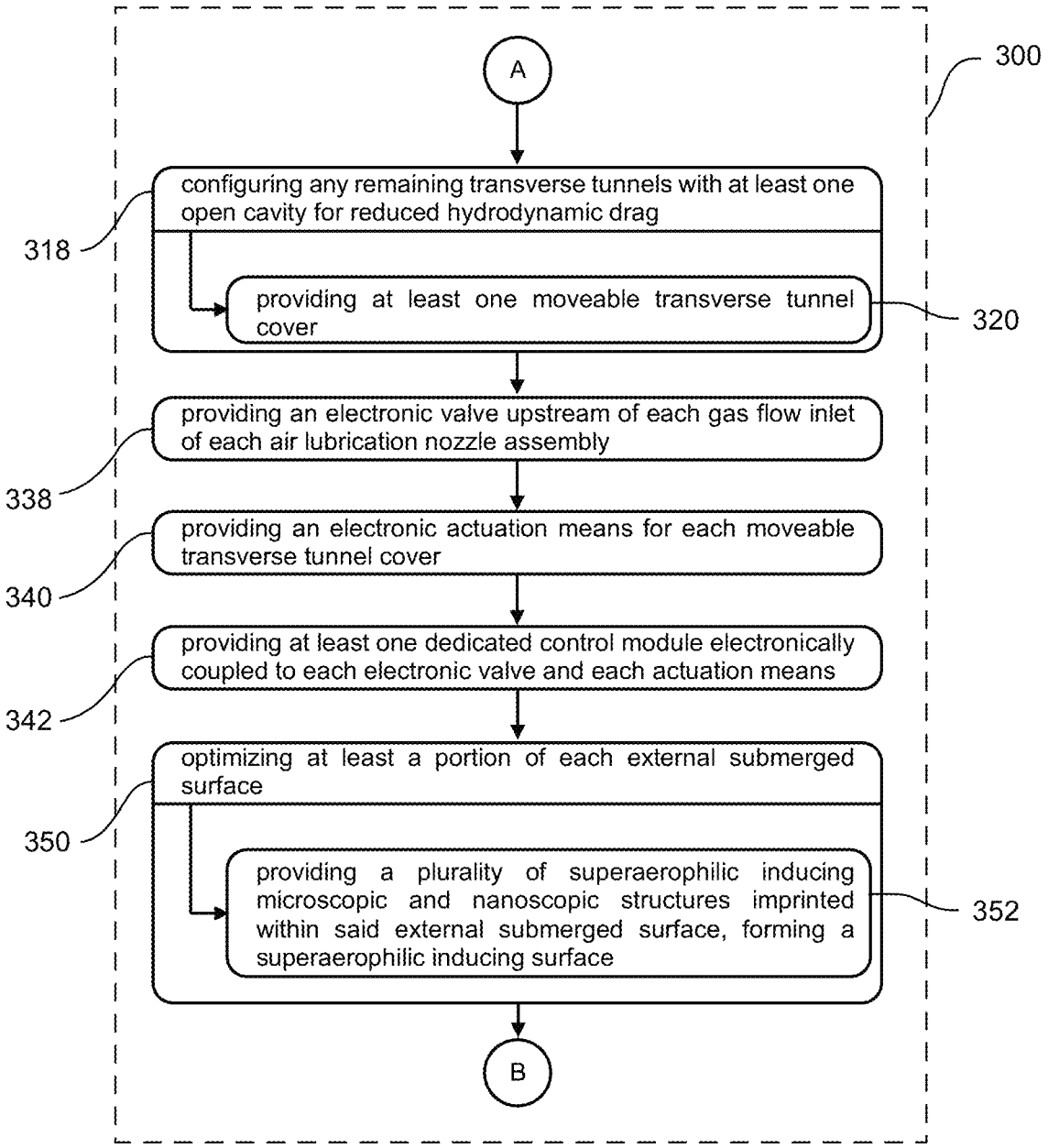
FIG. 18B illustrates a partial flow chart of a method for increasing efficiency of a watercraft by reducing drag.

FIG. 18B illustrates a partial flow chart of the method 300, continuing the flow chart from FIG. 18A, showing steps 318-352 including providing covers 320, optimizing surfaces 350, providing control modules 342, providing actuation means 340, providing valves 338, and configuring the transverse tunnels 318.

Figure 18C:
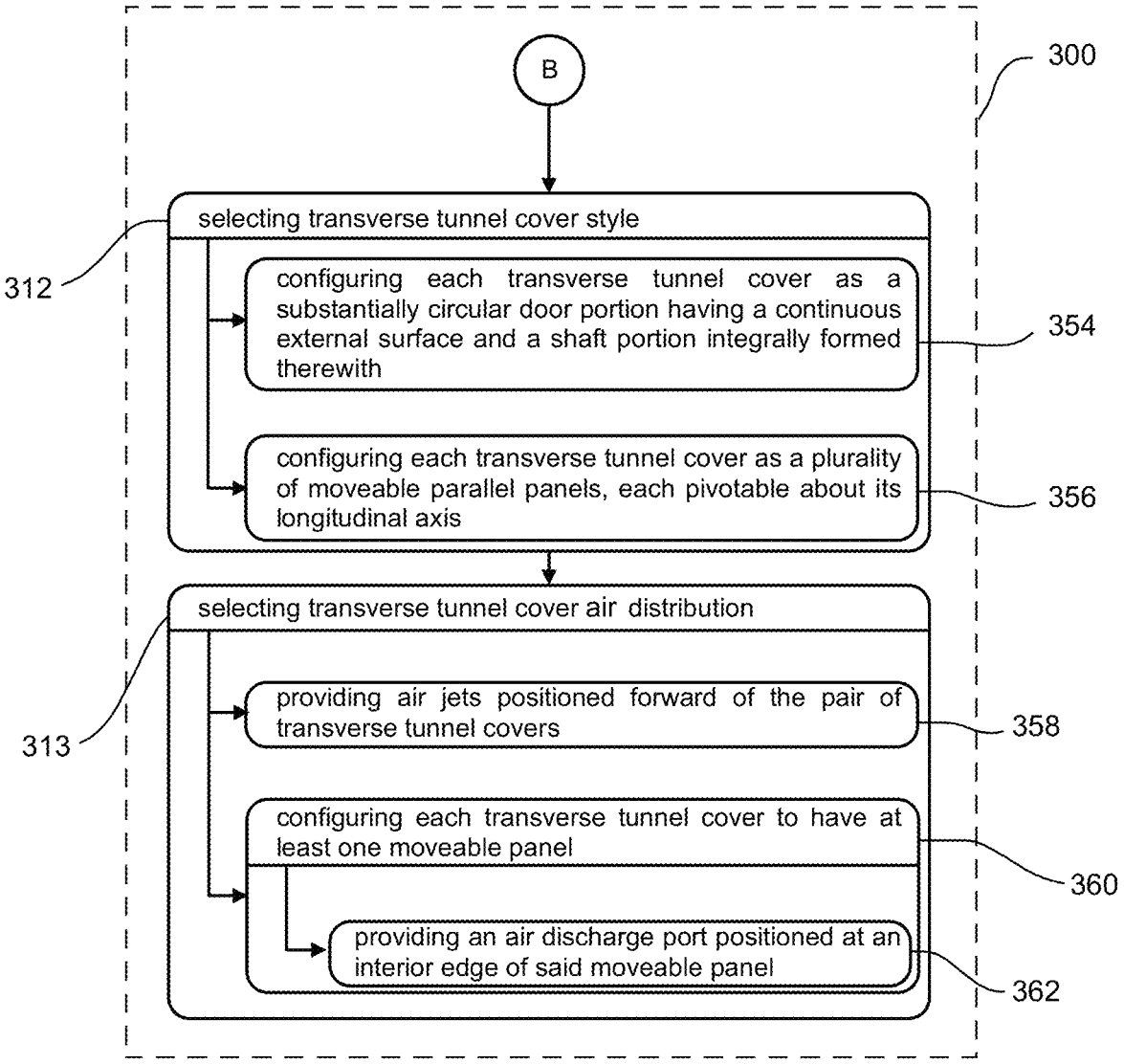
FIG. 18C illustrates a partial flow chart of a method for increasing efficiency of a watercraft by reducing drag.

FIG. 18C illustrates a final part of the partial flow chart of the method 300, as continued from FIGS. 18A and 18B showing steps 312-362 including selecting cover styles 312-313, configuring circular the doors 354, configuring the parallel panels 356, providing air jets 358, configuring panels 360, and providing discharge ports 362.

Figure 19:
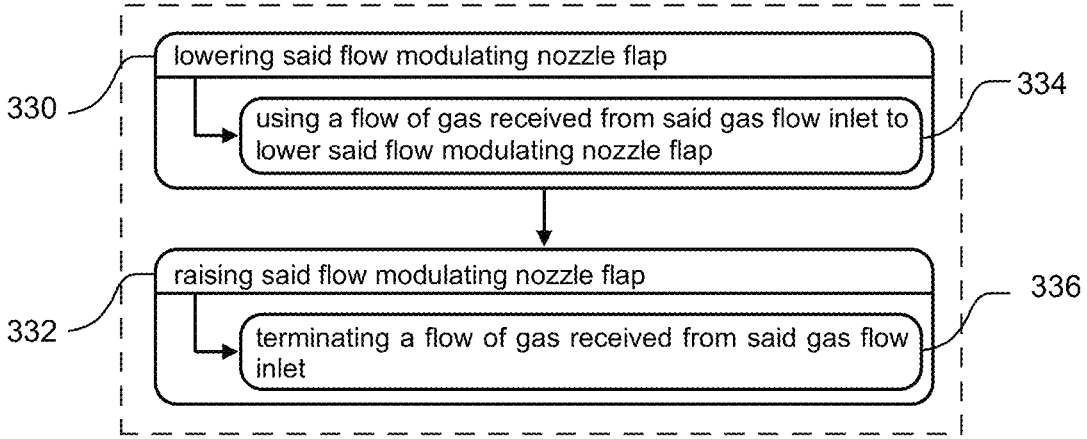
FIG. 19 illustrates a flow chart for a method of lowering and raising a nozzle flap.

FIG. 19 illustrates a flow chart for a method of lowering 330 and raising 332 a nozzle flap, including steps for gas flow control 334 and flow termination 336.

Figure 20:
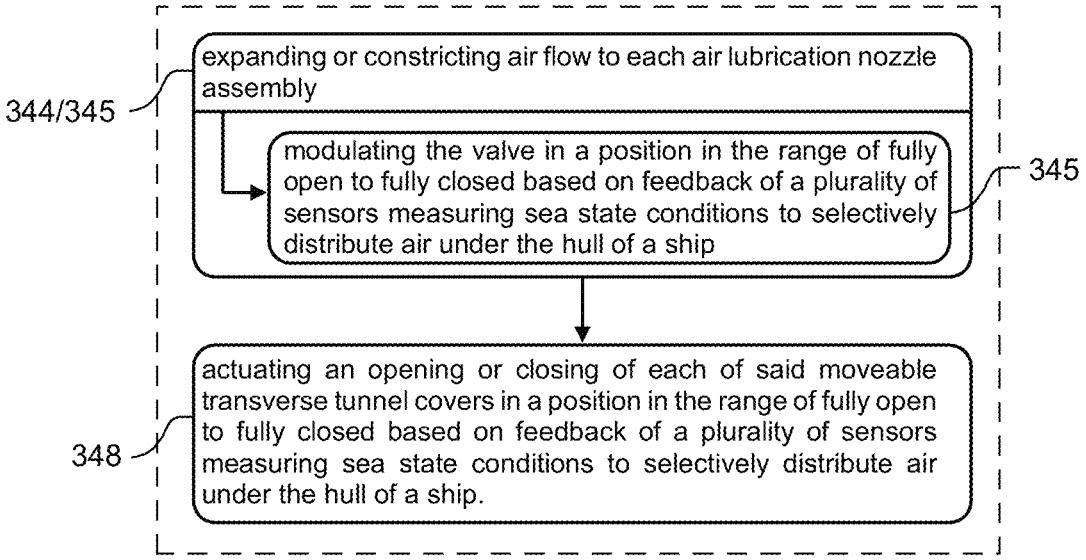
FIG. 20 illustrates a flow chart for a method of expanding or constricting airflow to the air lubrication nozzles to actuate the opening or closing of each nozzle.

FIG. 20 illustrates a flow chart for a method of expanding or constricting airflow 344/345 to the air lubrication nozzles and actuating cover positions 348 based on modulation parameters 345.

Figure 21:
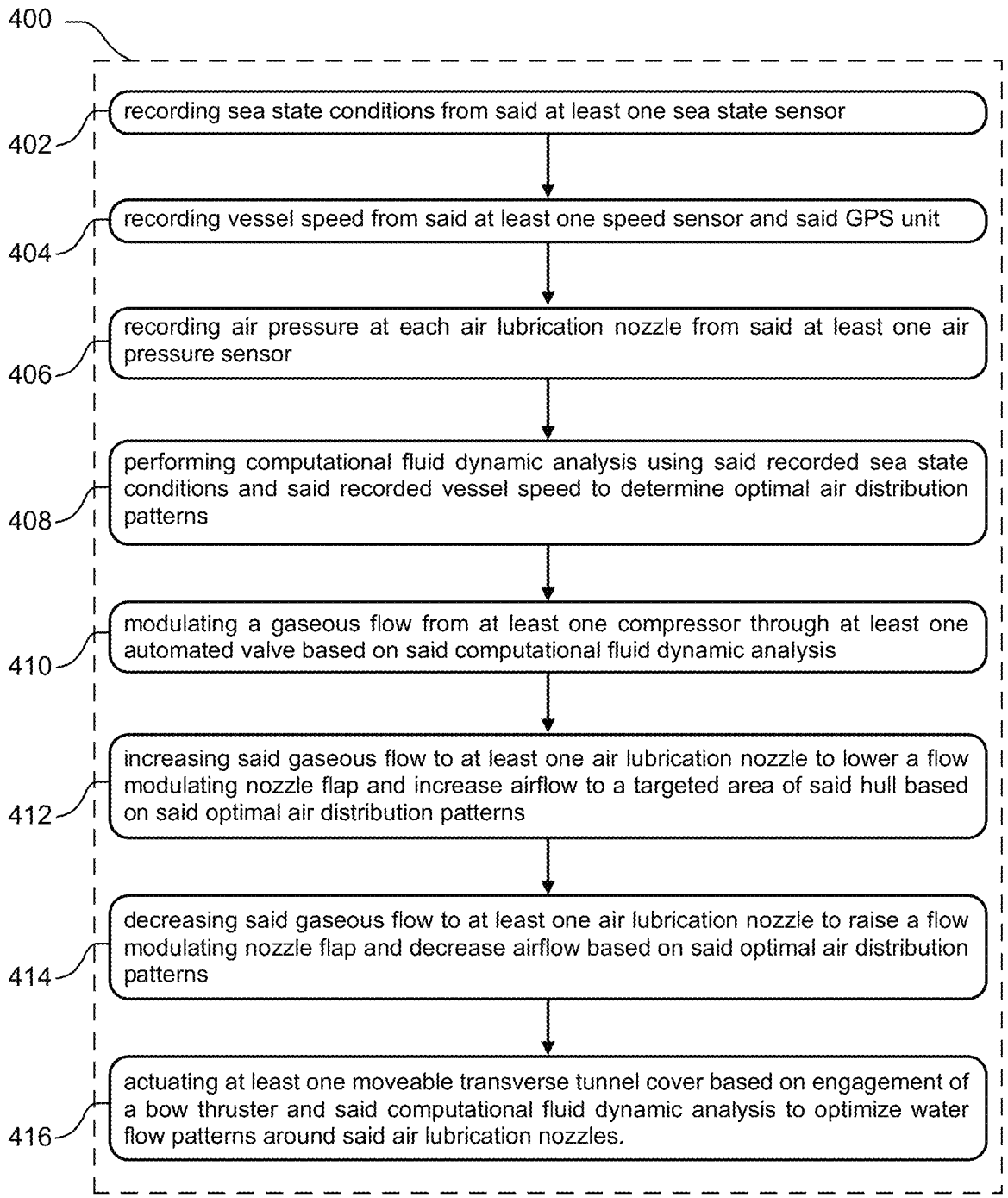
FIG. 21 illustrates a flow chart for method steps of a program for an automated control module of an active system for reducing hydrodynamic drag on a hull of a marine craft.

FIG. 21 illustrates a flow chart for method steps of a program 400 for an automated control module, including recording sea state conditions 402, vessel speed 404, and air pressure 406, performing computational analysis 408, modulating gas flow 410, increasing 412 and decreasing 414 airflow, and actuating covers 416.

In an exemplary embodiment, as may be appreciated in FIGS. 1-3 and 9-17B, a drag-reducing marine craft hatch 100 is disclosed. The drag-reducing marine craft hatch 100 comprises a moveable transverse tunnel cover 102 having an external submerged surface 104. The external submerged surface 104 has a plurality of superaerophilic inducing microscopic structures 106 and nanoscopic structures 108 imprinted within the external submerged surface 104, forming a superaerophilic inducing surface 110. Each superaerophilic inducing microscopic structure 106 defines a trench 106*a* and a ridge 106*b* geometry, wherein each ridge structure 106*b* defines a protruding structure 106*c*.

In some embodiments, each superaerophilic inducing nanoscopic structure 108 defines a trench 108*a* and a ridge 108*b* geometry covering all surface area of the protruding structures 106*c* of each of the superaerophilic inducing microscopic structure 106, wherein the surfaces of adjacent ridges 106*a* of the microscopic structures 106, extending between an intermediate trench 106*a* to a respective ridge 106*b* peak/top, progressively diverge away to define a V-shaped geometry, as may be seen in FIG. 17B.

In some embodiments, the moveable transverse tunnel cover 102 having an external submerged surface 104 comprises at least one moveable panel 112 positioned at an opening 114 of a transverse tunnel 116, and a panel rotator 118 capable of actuating each of the at least one moveable panel 112 from a closed position 113*a* to an open position 113*b*. The closed position 113*a* creates a substantially flush closure with surrounding ship hull 120 walls. The open position 113*b* creates a through-flow, as may be seen in FIG. 10.

In another exemplary embodiment of the invention, as may be appreciated in FIGS. 1-16, a hydrodynamically optimized submerged surface 122 of a marine craft 124 is disclosed. This hydrodynamically optimized surface configuration builds upon the previously discussed principles of reducing turbulence and creating stratified flow patterns, while integrating the air lubrication capabilities described in the technical narrative above. The hydrodynamically optimized submerged surface 122 of a marine craft 124 includes at least one moveable transverse tunnel cover 102 and an air lubrication nozzle assembly 126. These surfaces 104/128 form a substantially flush closure when not in use to avoid hydrodynamic drag. The air lubrication nozzle assembly 126 includes a main body 130 having an open cavity 132 therein, and a flow modulating nozzle flap 128 coupled to at least one longitudinal engagement area 134. The air lubrication nozzle assembly 126 is operable in a submerged environment 136. The main body 130 of the air lubrication nozzle assembly 126 includes a gas flow inlet 138, and an open lower boundary 140 configured to receive a flow modulating nozzle flap 128. The flap 128 of the air lubrication nozzle assembly 126 is configured to modulate and balance a direction and flow rate of a gaseous flow 142, wherein the flap 128 balances the air flow above with the hydrodynamic flow below. The embodiment also creates an engaged air layer 144 created from an air supply of the gaseous flow 142. In various implementations, the moveable transverse tunnel cover 102 may be configured in different ways to achieve optimal hydrodynamic performance (as may be appreciated in FIGS. 11A-16), including (by way of example and not limitation): as a circular door 112*a* with an integral shaft 115*a* for rotation, and also including as a series of parallel pivotable panels 112*b* forming either a solid surface, as seen in FIG. 11B, or louvred channel, as seen in FIG. 11A, depending on position, or with integrated air discharge ports 156*a*/156*b* at interior edges 158*a*/158*b* for strategic air distribution, as particularly seen in FIG. 15A or 15B. Additionally, the system may incorporate air jets 148 positioned forward of the covers, as shown in FIG. 16, recessed into the bow section 150, which may include recessed air jets 148 into the bulbous bow 150*a* section, to provide directed gas flow over the cover surfaces 104.

Each moveable transverse tunnel cover includes an external submerged surface 104. In some embodiments, the external submerged surface 104 has a plurality of superaerophilic inducing microscopic and nanoscopic structures 106/108 imprinted within the external submerged surface 104, forming a superaerophilic inducing surface 110. Each superaerophilic inducing microscopic structure 106 of the plurality of superaerophilic inducing microscopic and nanoscopic structures 106/108 defines a trench 106*a* and a ridge 106*b* geometry, wherein each ridge structure 106*b* defines a protruding structure 106*c*. This structure can be primarily appreciated in FIGS. 17A-17B.

In some embodiments, as shown in FIGS. 13A-15A each of the at least one moveable transverse tunnel covers 102 comprises a substantially circular door 112*a* portion having a continuous external surface 104 and a shaft 115*a* portion integrally formed therewith, wherein rotation of the door is accomplished by rotating the shaft 115*a*. A motor/actuator 152*a*, as shown in FIGS. 14A-14B, can rotate the shaft swinging the door 112*a* open and closed.

In some embodiments, as seen in FIGS. 11A-12B and 15-17B, each transverse tunnel cover 102 comprises a plurality of moveable parallel panels 112*b*. Each panel 112*b* is pivotable about its longitudinal axis 115*b*, whereby the panels form a substantially solid surface 104 when in a closed state. When in an open state, the louvred channel 154 permits fluid flow therethrough. A motor/actuator 152*b*, as shown in FIGS. 12A-12B, can raise and lower an actuation rod 115*c* to rotate opened and closed the louvred panels 112*b*.

In some embodiments, as shown in FIGS. 15A-15B, the moveable transverse tunnel covers 102 further comprises at least one 112*a*, or several 112*b*, moveable panel(s) 112, and an air discharge port 156*a*/156*b* positioned at an interior edge 158*a*/158*b* of each moveable panel 112*a*/112*b*. The air discharge port 156*a*/156*b* provides air distribution when the moveable panel 112*a*/112*b* is partially opened during forward movement of the marine craft 124.

In some embodiments, the moveable transverse tunnel covers 102 further comprises an air jet 148 positioned forward of the moveable transverse tunnel cover(s) 102, wherein the air jet 148 is recessed into a bow 150 section of the marine craft 124, as shown in FIG. 16, which may also include recessed jets 148 into a bulbous bow 150*a* if present. The air jet 148 is positioned to disburse a flow 142*a* of gas in an aft direction over an exterior surface 104 of the at least one moveable transverse tunnel cover 102.

An additional exemplary embodiment of the invention discloses a method 300 for increasing efficiency of a watercraft by reducing drag. Building on the automated control concepts discussed earlier, this method implements the practical steps needed to achieve the synergistic effects of the integrated system. The method 300 comprises configuring 302 portions of a ship's hull 120 for air delivery to the ship hull's lower surface by providing 304 at least one air delivery nozzle 126. Each of air delivery nozzle 126 is an air lubrication nozzle assembly 126. The method 300 includes providing 306 the air lubrication nozzle assembly 126. The air lubrication nozzle assembly 126 is capable of being immersed continuously in a liquid. The air lubrication nozzle assembly 126 includes a main body 130 having an open cavity 132 therein, wherein the main body 130 includes a gas flow inlet 138, and an open air-interface boundary 140*a* is disposed at a lower horizontal plane 140*b* of a submerged hull 120 of a ship surrounding the air-interface boundary 140*a*. The air lubrication nozzle assembly 126 is operable in a submerged environment 136. The method 300 further includes providing 308 a stratified flow of water to the open interface boundary 140*a* disposed at the lower horizontal plane 140*b* by providing 310 a pair of transverse tunnel covers 102 at distal openings 116*a*/116*b* of a submerged transverse tunnel 116 for each submerged transverse tunnel 116 at a bow 150 of the ship. The water flows over the exposed surface 104 of each transverse tunnel cover 102, thereby reducing turbulence and hydrodynamic drag caused by non-hydrodynamically optimized surfaces. Each moveable transverse tunnel cover 102 is disposed at a submerged substantially vertical plane, as may be appreciated in FIGS. 1, 9, and 10. The method 300 can be enhanced through various optimizations, including: selecting 312 transverse tunnel cover style, including configuring 314 covers as circular doors 112*a* with integral shafts 115*a*, implementing parallel pivotable panels 112*b*, incorporating air discharge ports 156*a*/156*b*, and strategically positioning air jets 148 in the bow section 150. The method 300 may also include optimizing 316 external surfaces 104 through superaerophilic inducing microscopic structures 106 and nanoscopic structures 108, providing enhanced water flow characteristics and air retention properties. The implementation can be further refined through electronic valve control and actuation systems that respond to sea state conditions, enabling dynamic adjustment of both air flow and cover positions.

In some embodiments, the method 300 for increasing efficiency of a watercraft by reducing drag includes configuring 318 any remaining transverse tunnels 116 (with at least one open cavity) for reduced hydrodynamic drag by providing 320 at least one moveable transverse tunnel cover 102. Each moveable transverse tunnel cover 102 is disposed at a submerged substantially vertical plane. This is particularly important for other cavities and suction lines separate than a bow thruster cover tunnel 116.

In some embodiments of the method 300 for increasing efficiency of a watercraft by reducing drag, the step of configuring 302 portions of a ship's hull 120 for air delivery to the ship's hull's lower surface by providing 304 at least one air delivery nozzle 126 further includes configuring 322 the open air-interface boundary 140*a* to be substantially coplanar with an adjacent surface 120*a* of the marine vessel 124 hull 120, configuring 324 the open air-interface 140*a* to receive a flow modulating nozzle flap 128 by providing 326 a longitudinal engagement area 134, and providing 328 a flow modulating nozzle flap 128. The flow modulating nozzle flap 128 is coupled 329 to the at least one longitudinal engagement area 134. The flap 128 is configured to modulate a direction and flow rate of a gaseous flow 142. The main body 130 of each nozzle 126 is recessed up into the ship's hull 120.

In some embodiments of the method 300 for increasing efficiency of a watercraft by reducing drag, the air lubrication nozzle assembly 126 is capable of performing the steps of lowering 330 the flow modulating nozzle flap 128 and raising 332 the flow modulating nozzle flap 128. The step of lowering 330 the flow modulating nozzle flap 128 is accomplished by using a flow of gas 142 received from the gas flow inlet 138 to lower the flow modulating nozzle flap 128. A flow of gas 142 disburses uniformly in the open cavity 132 of the main body 130, thereby pressing on the flow modulating nozzle flap 128 to allow air bubbles to disburse to an underside of a marine craft's hull 120, when air is required under the marine craft's hull 120. The step of raising 332 the flow modulating nozzle flap 128 is accomplished by terminating 336 a flow of gas 142 received from the gas flow inlet 138, whereby a passive lifting system is incorporated into the flow modulating nozzle flap 128 allows for self-closure when the air is no longer required under the marine craft's hull 120. The passive lifting incorporates the flap's 128 natural buoyancy and the flow of water under the flap to keep the flap in a substantially closed position.

In some embodiments, the method 300 for increasing efficiency of a watercraft by reducing drag further includes providing 338 an electronic valve 164 upstream of each gas flow inlet 138 of each air lubrication nozzle assembly 126, providing 340 an electronic actuation means 152*a*/152*b* for each moveable transverse tunnel cover 102, and providing 342 at least one dedicated control module 173 electronically coupled to each electronic valve 164 and each actuation means 152*a*/152*b*. The at least one dedicated control module 173 includes at least one processor 173*a*, memory 173*b*, and an input/output connection 173*c* facilitating the electronic couplement, whereby the memory 173*b* includes a program stored thereon, including at least the steps of expanding 344 or constricting 346 air flow to each air lubrication nozzle assembly 126 and actuating 348 an opening or closing of each of the moveable transverse tunnel covers 102. Expanding 344 or constricting 346 air flow to each air lubrication nozzle assembly 126 is accomplished by modulating 345 the valve 164 in a position in the range of fully open to fully closed based on feedback of a plurality of sensors measuring sea state conditions (e.g., Doppler 174, gyro 176, GPS unit 178, and radar 180) to selectively distribute air under the hull 120 of a ship, and actuating 348 an opening or closing of each of the moveable transverse tunnel covers 102 in a position in the range of fully open to fully closed based on feedback of the plurality of sensors.

In some embodiments, the method 300 for increasing efficiency of a watercraft by reducing drag further includes optimizing 350 at least a portion of each external submerged surface 104 by providing 352 a plurality of superaerophilic inducing microscopic structures 106 and nanoscopic structures 108 imprinted within the external submerged surface 104, thereby forming a superaerophilic inducing surface 110. Each superaerophilic inducing microscopic structure 106 of the plurality of superaerophilic inducing microscopic and nanoscopic structures defines a trench 106*a* and a ridge 106*b* geometry. Each ridge structure 106*b* defines a protruding structure 106*c*. Each superaerophilic inducing nanoscopic structure 108 of the plurality of superaerophilic inducing microscopic and nanoscopic structures defines a trench 108*a* and a ridge 108*b* geometry covering all surface area of the protruding structures 106*c* of each of the superaerophilic inducing microscopic structure 106. The surfaces of adjacent ridges 106*b* of the microscopic structures 106, extends between an intermediate trench 106*a* to a respective ridge 106*b* peak/top, progressively diverge away to define a V-shaped geometry. Each submerged surface includes an external surface including each the flow modulating nozzle flap 128, each moveable transverse tunnel cover 102, and the ship's hull 120.

In some embodiments, the method 300 for increasing efficiency of a watercraft by reducing drag further includes configuring 354 each transverse tunnel cover 102 as a substantially circular door 112*a* portion having a continuous external surface and a shaft 115*a* portion integrally formed therewith, wherein rotation of the door 112*a* is accomplished by rotating the shaft 115*a*.

In some embodiments, the method 300 for increasing efficiency of a watercraft by reducing drag further includes configuring 356 each transverse tunnel cover 102 as a plurality of moveable parallel panels 112*b*, each pivotable about its longitudinal axis 115*b*, whereby the plurality of moveable parallel panels 112*b* form a substantially solid exterior surface 104 in a closed state, and a louvred channel 154 in an open state to permit fluid flow therethrough.

In some embodiments, the method 300 for increasing efficiency of a watercraft by reducing drag further includes selecting 313 the transverse tunnel cover air distribution system, providing 358 at least a pair of air jets 148 positioned forward of the pair of transverse tunnel covers 102, wherein each the air jet 148 is recessed into a bow section 150 of the marine craft, and each the air jet 148 is positioned to disburse a flow of gas 142*a* in an aft direction over an exterior surface 104 of each transverse tunnel cover 102.

In some embodiments, the method 300 for increasing efficiency of a watercraft by reducing drag further includes configuring 360 each transverse tunnel cover 102 to have at least one moveable panel 112. The method 300 also includes providing 362 an air discharge port 156*a*/156*b* positioned at an interior edge 158*a*/158*b* of the moveable panel 112, whereby the air discharge port 156*a*/156*b* provides air distribution when the moveable panel 112 is partially opened during forward movement of the marine craft 124.

In a further exemplary embodiment, an active system 200 for reducing hydrodynamic drag on a hull 120 of a marine craft active system 124, is disclosed. Drawing from the computational fluid dynamic analysis principles discussed in the technical narrative, this active system 200 represents the comprehensive integration of all previously discussed components. The system 200 comprises an automated air distribution system 168, as shown in FIGS. 1-2. The automated air distribution system 168 includes at least one compressor 160 with a distributed automation-control module 162, at least one airflow modulation valve(s) 164, and at least one air lubrication nozzle 126. The automated air distribution system 168 couples the one or more compressors 160 to an automated valve 164 utilizing a plurality of air conduits 166. The automated air distribution system 168 couples each automated valve 164 to at least one air lubrication nozzle 126 using at least one air conduit 166. Each automated valve 164 includes a distributed automation-control module 170. The system also includes at least one moveable transverse tunnel cover 102 with an external submerged surface 104. Each moveable transverse tunnel cover 102 includes a controllable motor and/or actuator 152*a*/152*b*, a user interface module 172, and a central automation-control module 173 (which may be typically referred to as a central server, or central control computer) electronically coupled to at least each distributed automation-control module 162 on each compressor 160, each distributed automation-control module 170 at each automated valve 164, each controllable actuator 152*a*/152*b*, and coupled to the user interface module 172. The system can incorporate various sensor types and control mechanisms, including sea state sensors (such as Doppler 174, gyro 176, GPS units 178, and radar 180), airflow sensors between the valve 164 and nozzle 126 (such as air temperature sensors 182, air speed sensors 184, air pressure sensors 186), all feeding into the central automation-control module 173. This module 173 executes sophisticated programs that record conditions, perform computational fluid dynamic analysis, and optimize both air distribution and cover positions in real-time. The system 200 may be implemented with different cover 102 configurations, including circular doors 112*a* with integral shafts 115*a* or parallel pivotable panels 112*b*, each designed to optimize flow characteristics while maintaining system efficiency.

In some embodiments, each air lubrication nozzle 126, as seen in FIGS. 4A-8, comprises a main body 130 having an open cavity 132 therein, a gas flow inlet 138 in the main body 130, and an open lower boundary 140 making up an open air-interface boundary 140*a* where the airflow interfaces with a hydrodynamic flow disposed at a lower horizontal plane 140*b*. The open air-interface boundary 140 is substantially coplanar with an adjacent surface 120*a* of the hull 120*b*. The main body 130 has at least one longitudinal engagement area 134 at the open air-interface boundary 140*a*, and a flow modulating nozzle flap 128 coupled to the longitudinal engagement area 134. The flow modulating nozzle flap 128 is configured to modulate and balance a direction and flow rate of a gaseous flow 142.

In some embodiments, the active system 200 for reducing hydrodynamic drag on a hull 120 of a marine craft 124 further comprises at least one pair of moveable transverse tunnel covers 102 positioned at distal ends 116*a*/116*b* of a transverse tunnel 116, as may be appreciated in FIGS. 1, 3, 9, and 10.

In some embodiments, each moveable transverse tunnel cover 102 is positioned at distal ends 116*a*/116*b* of the transverse tunnel 116 and comprises a substantially circular door 112*a* portion having a continuous external surface 104. A shaft 115*a* portion is integrally formed therewith, wherein rotation of the door 112*a* is accomplished by rotating the shaft 115*a*. This can be seen in FIGS. 13A-15A.

In some embodiments, each moveable transverse tunnel cover 102 comprises a plurality of moveable parallel panels 112*b*, as may be seen in FIGS. 11A-12B and 15B-17A. Each panel 112*b* is pivotable about its longitudinal axis 115*b*, whereby the plurality of moveable parallel panels 112*b* form a substantially solid external submerged surface 104 in a closed state, and a louvred channel 154 in an open state to permit fluid flow therethrough.

In some embodiments, each moveable transverse tunnel cover 102 in the pair of moveable transverse tunnel covers positioned at the distal ends of the transverse tunnel comprises a moveable panel 112/112*a*/112*b*. An air discharge port 156*a*/156*b* is positioned at an interior edge 158*a*/148*b* of the moveable panel, as may be seen in FIGS. 15A-15B. During forward movement of the marine craft 124, when the moveable panel 112/112*a*/112*b* is partially opened, the air discharge port 156*a*/156*b* provides air distribution. This configuration allows for strategic air delivery at the bow thruster tunnel 116 openings 116*a*/116*b* while maintaining the drag-reducing capabilities of the moveable covers 112/112*a*/112*b*.

In some embodiments, an air jet 148 is positioned forward of the at least one moveable transverse tunnel cover 102. The air jet 148 is recessed into a bow section 150 of the marine craft and is positioned to disburse a flow of gas 142*a* in an aft direction over the exterior surface 104 of each transverse tunnel cover 102.

In some embodiments, the active system 200 for reducing hydrodynamic drag on a hull 120 of a marine craft 124 further comprises at least one sea state sensor (such as Doppler 174, gyro 176, at least one GPS unit 178, and radar 180), and at least one air temperature sensors 182, at least one air speed sensor 184, at least one air pressure sensors 186, positioned between each automated valve 164 and each air lubrication nozzle 126, and a central automation-control module 173. The central automation-control module 173 has at least a processor 173*a*, a memory 173*b*, and input/output connections 173*c* electronically coupled to each sea state sensor 174, 176, 178, 180, each speed sensor 184, each air pressure sensor 186, each air temperature sensor 182, each GPS unit 178, each distributed automation-control module 162 on each compressor 160, each distributed automation-control module 170 at each automated valve 164, and each controllable actuator 152*a*/152*b* control module 188. The connections described are particularly shown in FIG. 2.

In some embodiments, the memory 173*b* includes a program 400 stored thereon, whereby once executed by the processor 173*a* performs the steps of recording 402 sea state conditions from the at least one sea state sensor (such as Doppler 174, gyro 176, at least one GPS unit 178, and radar 180), recording 404 vessel speed from the at least one speed sensor 184 and the GPS unit 178, recording 406 air pressure at each air lubrication nozzle 126 from the at least one air pressure sensor 186, performing 408 computational fluid dynamic analysis using the recorded sea state conditions and the recorded vessel speed to determine optimal air distribution patterns, modulating 410 a gaseous flow 142 from at least one compressor 160 through at least one automated valve 164 based on the computational fluid dynamic analysis, increasing 412 the gaseous flow 142 to at least one air lubrication nozzle 126 to lower a flow modulating nozzle flap 128 and increase airflow to a targeted area of the hull 120 based on the optimal air distribution patterns, decreasing 414 the gaseous flow 142 to at least one air lubrication nozzle 126 to raise a flow modulating nozzle flap 128 and decrease airflow based on the optimal air distribution patterns, and actuating 416 at least one moveable transverse tunnel cover 102 based on engagement of a bow thruster 116 and the computational fluid dynamic analysis to optimize water flow patterns around the air lubrication nozzles 126.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

We claim:

1. A hydrodynamically optimized submerged surface of a marine craft, comprising:

at least one moveable transverse tunnel cover;

an air lubrication nozzle assembly, wherein said air lubrication nozzle assembly includes a sea chest having an open cavity therein, wherein said sea chest includes a gas flow inlet, and an open lower boundary;

a flow modulating nozzle flap, wherein said flap is configured to modulate a direction and flow rate of a gaseous flow;

said open lower boundary is configured to receive said flow modulating nozzle flap;

said sea chest having at least one longitudinal engagement area, wherein said at least one longitudinal engagement area is a rigidly fixed semi-circumferential bracket for mounting said flow modulating nozzle flap, wherein said rigidly fixed semi-circumferential bracket is affixed semi-circumferentially at a border of said open lower boundary;

said flow modulating nozzle flap is coupled to said at least one longitudinal engagement area;

wherein said air lubrication nozzle assembly is operable in a submerged environment; and an engaged air layer created from an air supply of said gaseous flow.

2. The hydrodynamically optimized submerged surface of a marine craft, as recited in claim 1, wherein each moveable transverse tunnel cover in said at least one moveable transverse tunnel cover includes an external submerged surface;

said external submerged surface having a plurality of superaerophilic inducing microscopic and nanoscopic structures imprinted within said external submerged surface, forming a superaerophilic inducing surface; and each superaerophilic inducing microscopic structure of said plurality of superaerophilic inducing microscopic and nanoscopic structures defines a trench and a ridge geometry, wherein each ridge structure defines a protruding structure.

3. The hydrodynamically optimized submerged surface of a marine craft, as recited in claim 1, wherein each of said at least one moveable transverse tunnel cover comprises:

a substantially circular door having a continuous external surface and a shaft integrally formed therewith, wherein rotation of said door is accomplished by rotating said shaft.

4. The hydrodynamically optimized submerged surface of a marine craft, as recited in claim 1, wherein each of said at least one moveable transverse tunnel cover comprises:

a plurality of moveable parallel panels, each pivotable about its longitudinal axis, whereby said plurality of moveable parallel panels form a substantially solid surface in a closed state, and a louvred channel in an open state to permit fluid flow therethrough.

5. The hydrodynamically optimized submerged surface of a marine craft, as recited in claim 1, further comprising:

an air jet positioned forward of said at least one moveable transverse tunnel cover, wherein said air jet is recessed into a bow section of said marine craft, and said air jet is positioned to disburse a flow of gas in an aft direction over an exterior surface of said at least one moveable transverse tunnel cover.

6. A hydrodynamically optimized submerged surface of a marine craft, comprising:

at least one moveable transverse tunnel cover, wherein said at least one of said moveable transverse tunnel cover further comprises:

a moveable panel; and an air discharge port positioned at an interior edge of said moveable panel, whereby said air discharge port provides air distribution when said moveable panel is partially opened during forward movement of said marine craft;

an air lubrication nozzle assembly, wherein said air lubrication nozzle assembly includes a main body having an open cavity therein, a flow modulating nozzle flap coupled to at least one longitudinal engagement area, wherein said air lubrication nozzle assembly is operable in a submerged environment;

said main body of said air lubrication nozzle assembly includes a gas flow inlet, and an open lower boundary configured to receive said flow modulating nozzle flap;

said flap of said air lubrication nozzle assembly is configured to modulate a direction and flow rate of a gaseous flow; and an engaged air layer created from an air supply of said gaseous flow.

7. A method for increasing efficiency of a watercraft by reducing drag, the method comprising:

configuring portions of a watercraft's hull for air delivery to said watercraft's hull's lower surface by providing at least one air delivery nozzle, wherein each of said at least one air delivery nozzle is an air lubrication nozzle assembly, wherein said air lubrication nozzle assembly is capable of being immersed continuously in a liquid, and said air lubrication nozzle assembly includes:

a main body having an open cavity therein, wherein said main body includes a gas flow inlet, and an open air-interface boundary is disposed at a lower horizontal plane of a submerged hull of said watercraft surrounding said air-interface boundary; and wherein said air lubrication nozzle assembly is operable in a submerged environment;

providing a stratified flow of water to said open interface boundary disposed at said lower horizontal plane by providing a pair of transverse tunnel covers at distal openings of each of said at least one submerged transverse tunnel at a bow of said watercraft, whereby water flows over an exposed surface of each of said transverse tunnel covers thereby reducing turbulence and hydrodynamic drag caused by non-hydrodynamically optimized surfaces, wherein each of said transverse tunnel covers further comprises:

a moveable panel; and an air discharge port positioned at an interior edge of said moveable panel, whereby said air discharge port provides air distribution when said moveable panel is partially opened during forward movement of said watercraft; and wherein each of said moveable transverse tunnel covers is disposed in a submerged substantially vertical plane.

8. The method for increasing efficiency of a watercraft by reducing drag, as recited in claim 7, wherein said step of configuring portions of a watercraft's hull for air delivery to said watercraft's hull's lower surface by providing at least one air delivery nozzle further includes:

configuring said open air-interface boundary to be substantially coplanar with an adjacent surface of the watercraft's hull;

configuring said open air-interface to receive a flow modulating nozzle flap by providing a longitudinal engagement area;

providing a flow modulating nozzle flap, whereby said flow modulating nozzle is coupled to said longitudinal engagement area, wherein said flap is configured to modulate a direction and flow rate of a gaseous flow; and wherein the main body of each nozzle is recessed up into the watercraft's hull.

9. The method for increasing efficiency of a watercraft by reducing drag, as recited in claim 8, wherein the air lubrication nozzle assembly is capable of performing the steps of:

lowering said flow modulating nozzle flap by using a flow of gas received from said gas flow inlet to lower said flow modulating nozzle flap, wherein a flow of gas disburses uniformly in the open cavity of the main body, thereby pressing on said flow modulating nozzle flap to allow air bubbles to disburse to an underside of the watercraft's hull, when air is required under said watercraft's hull; and raising said flow modulating nozzle flap by terminating a flow of gas received from said gas flow inlet, whereby a passive lifting system is incorporated into the flow modulating nozzle flap to allow for self-closure when said air is no longer required under said watercraft's hull.

10. The method for increasing efficiency of a watercraft by reducing drag, as recited in claim 7, further comprising:

providing an electronic valve upstream of each gas flow inlet of each air lubrication nozzle assembly;

providing an electronic actuation means for each moveable transverse tunnel cover; and providing at least one dedicated control module electronically coupled to each electronic valve and each actuation means, wherein said at least one dedicated control module includes at least one processor, memory, and an input/output connection facilitating said electronic couplement, whereby said memory includes a program stored thereon, including at least the steps of:

expanding or constricting air flow to each air lubrication nozzle assembly by modulating the valve in a position in the range of fully open to fully closed based on feedback of a plurality of sensors measuring sea state conditions to selectively distribute air under the hull of the watercraft; and actuating an opening or closing of each of said moveable transverse tunnel covers in a position in the range of fully open to fully closed based on feedback of a plurality of sensors measuring sea state conditions to selectively distribute air under the hull of the watercraft.

11. The method for increasing efficiency of a watercraft by reducing drag, as recited in claim 10, further comprising:

optimizing at least a portion of each external submerged surface by providing a plurality of superaerophilic inducing microscopic and nanoscopic structures imprinted within said external submerged surface, forming a superaerophilic inducing surface;

each superaerophilic inducing microscopic structure of said plurality of superaerophilic inducing microscopic and nanoscopic structures defines a trench and a ridge geometry, wherein each ridge structure defines a protruding structure;

wherein each superaerophilic inducing nanoscopic structure of said plurality of superaerophilic inducing microscopic and nanoscopic structures defines a trench and a ridge geometry covering all surface area of said protruding structures of each of said superaerophilic inducing microscopic structure, wherein surfaces of adjacent ridges of the microscopic structures, extending between an intermediate trench to a respective ridge peak/top, progressively diverge away to define a V-shaped geometry; and wherein each submerged surface includes an external surface of each said flow modulating nozzle flap, each moveable transverse tunnel cover, and said watercraft's hull.

12. The method for increasing efficiency of a watercraft by reducing drag, as recited in claim 7, further comprising:

configuring each of said transverse tunnel covers as a substantially circular door portion having a continuous external surface and a shaft portion integrally formed therewith, wherein rotation of said door is accomplished by rotating said shaft.

13. The method for increasing efficiency of a watercraft by reducing drag, as recited in claim 7, further comprising:

configuring each of said transverse tunnel covers as a plurality of moveable parallel panels, each pivotable about its longitudinal axis, whereby said plurality of moveable parallel panels form a substantially solid surface in a closed state, and a louvred channel in an open state to permit fluid flow therethrough.

14. The method for increasing efficiency of a watercraft by reducing drag, as recited in claim 7, further comprising the step of:

providing at least a pair of air jets positioned forward of said pair of transverse tunnel covers, wherein each said air jet is recessed into a bow section of said watercraft, and each said air jet is positioned to disburse a flow of gas in an aft direction over an exterior surface of each of said transverse tunnel covers.

15. A method for increasing efficiency of a watercraft by reducing drag, the method comprising:

configuring portions of a watercraft's hull for air delivery to said watercraft's hull's lower surface by providing at least one air delivery nozzle, wherein each of said at least one air delivery nozzle is an air lubrication nozzle assembly, wherein said air lubrication nozzle assembly is capable of being immersed continuously in a liquid, and said air lubrication nozzle assembly includes:

a main body having an open cavity therein, wherein said main body includes a gas flow inlet, and an open air-interface boundary is disposed at a lower horizontal plane of a submerged hull of said watercraft surrounding said air-interface boundary; and wherein said air lubrication nozzle assembly is operable in a submerged environment;

providing a stratified flow of water to said open interface boundary disposed at said lower horizontal plane by providing a pair of transverse tunnel covers at distal openings of each of said at least one submerged transverse tunnel at a bow of said watercraft, whereby water flows over an exposed surface of each of said transverse tunnel covers thereby reducing turbulence and hydrodynamic drag caused by non-hydrodynamically optimized surfaces, wherein each of said transverse tunnel covers further comprises:

at least two moveable panels; and an air discharge port positioned at an interior edge of at least one of said at least two moveable panels, whereby said air discharge port provides air distribution when said at least two moveable panels are partially opened during forward movement of said watercraft; and wherein each of said moveable transverse tunnel covers is disposed in a submerged substantially vertical plane.

* * * * *